US006923350B2

(12) United States Patent
Gouldson et al.

(10) Patent No.: US 6,923,350 B2
(45) Date of Patent: Aug. 2, 2005

(54) PINCH GRIP HANGER

(75) Inventors: Stanley F. Gouldson, Northport, NY (US); Olaf Olk, Hauppauge, NY (US)

(73) Assignee: Spotless Plastics Pty. Ltd., Moorabbin (AU)

( * ) Notice: Subject to any disclaimer, the term of this patent is extended or adjusted under 35 U.S.C. 154(b) by 0 days.

(21) Appl. No.: 10/292,128

(22) Filed: Nov. 12, 2002

(65) Prior Publication Data

US 2003/0209577 A1 Nov. 13, 2003

Related U.S. Application Data

(63) Continuation-in-part of application No. 10/076,790, filed on Feb. 15, 2002.

(51) Int. Cl.[7] ..... A41D 27/22
(52) U.S. Cl. ..... 223/96
(58) Field of Search ..... 223/96

(56) References Cited

U.S. PATENT DOCUMENTS

| | | | | |
|---|---|---|---|---|
| 670,027 | A | 3/1901 | Malmberg | |
| 2,487,445 | A | 11/1949 | Johnson | |
| 2,496,531 | A | 2/1950 | Gray | |
| 3,406,883 | A | 10/1968 | Crane | |
| 3,550,784 | A | 12/1970 | Batts et al. | |
| 3,698,043 | A | 10/1972 | Batts | |
| 3,698,607 | A * | 10/1972 | Batts | 223/96 |
| 3,745,616 | A | 7/1973 | Batts | |
| 3,767,092 | A | 10/1973 | Garrison | |
| 3,824,671 | A | 7/1974 | Watkin | |
| 3,859,710 | A | 1/1975 | Batts et al. | |
| 3,923,213 | A | 12/1975 | George et al. | |
| 3,946,915 | A | 3/1976 | Crane | |
| 3,973,705 | A | 8/1976 | Erthein | |
| 4,009,807 | A | 3/1977 | Coon | |
| 4,023,721 | A | 5/1977 | Erthein | |
| 4,115,940 | A | 9/1978 | Phillips | |
| 4,157,782 | A | 6/1979 | Mainetti | |
| 4,169,549 | A | 10/1979 | Takagi | |
| 4,187,967 | A | 2/1980 | Garrison | |
| 4,192,441 | A | 3/1980 | Batts | |
| 4,194,274 | A | 3/1980 | Garrison | |
| 4,209,879 | A | 7/1980 | Paajanen | |
| 4,231,500 | A | 11/1980 | Mainetti | |
| 4,295,585 | A | 10/1981 | Garrison | |
| 4,322,902 | A | 4/1982 | Lenthall | |
| 4,349,127 | A | 9/1982 | Savard, Jr. | |
| 4,355,743 | A | 10/1982 | Erthein | |

(Continued)

FOREIGN PATENT DOCUMENTS

| | | |
|---|---|---|
| DE | 2037995 | 2/1972 |
| EP | 0095353 A1 | 11/1983 |
| EP | 0095353 B1 | 11/1983 |
| EP | 0007246 A1 | 1/1990 |
| FR | 2050296 | 4/1971 |
| WO | WO 90/09651 | 8/1990 |

*Primary Examiner*—John J. Calvert
*Assistant Examiner*—James Smith
(74) *Attorney, Agent, or Firm*—Scully, Scott, Murphy & Presser

(57) ABSTRACT

An improved pinch grip pant and skirt hanger of reduced depth and elongated grip is formed for gripping garments below the waistband. The pinch grip has an offset between the hanger bar and the mounting of the pinch grip to align the center axis of the hanger bar with the center of the pinch grip, to thereby reduce the depth of the hanger and pinch grip and provide greater density of garments during shipment. Two separate guards are provided to prevent inadvertent opening of the pinch grip by an adjacent hanger, including a moveable guard, formed by arches on the fixed and moveable jaws. Since the arches are formed to contact below the pivot axis of the pinch grip, any contact between hangers will serve to enhance grip, rather than inadvertently opening the pinch grip. The hanger is particularly adapted for magazine feed and the automated loading of garments.

24 Claims, 14 Drawing Sheets

U.S. PATENT DOCUMENTS 4,381,599 A 5/1983 Duester et al.
4,383,362 A 5/1983 Graniero et al.
4,395,799 A 8/1983 Batts
D271,649 S 12/1983 Batts et al.
4,446,996 A * 5/1984 Garrison ..... 223/96
4,565,309 A 1/1986 Batts et al.
4,706,347 A 11/1987 Lindsay
4,718,581 A 1/1988 Chiaramonte
4,826,056 A 5/1989 Duester et al.
4,871,097 A 10/1989 Blanchard et al.
4,873,878 A 10/1989 Milton
5,075,935 A 12/1991 Abdi
5,082,153 A 1/1992 Duester et al.
5,096,101 A 3/1992 Norman et al.
D332,180 S 1/1993 Marshall et al.
5,199,608 A 4/1993 Zuckerman
5,212,854 A * 5/1993 Hollis ..... 24/487
5,238,159 A 8/1993 Zuckerman
D341,947 S 12/1993 Marshall et al.
5,267,678 A * 12/1993 Zuckerman ..... 223/96
5,272,806 A 12/1993 Marshall et al.
5,285,566 A 2/1994 Marshall et al.
5,400,932 A * 3/1995 Hollis ..... 223/96
5,507,086 A 4/1996 Marshall et al.
5,516,014 A 5/1996 Garrison et al.
5,568,685 A 10/1996 Marshall et al.
5,595,331 A 1/1997 Leistner
5,604,975 A 2/1997 Marshall et al.
5,785,216 A 7/1998 Gouldson et al.
5,794,363 A 8/1998 Marshall et al.
5,934,525 A * 8/1999 Blanchard ..... 223/96
6,019,261 A 2/2000 Morgan et al.
6,021,933 A * 2/2000 Zuckerman ..... 223/96
6,202,906 B1 3/2001 Zuckerman
6,260,745 B1 7/2001 Gouldson et al.
6,421,910 B1 7/2002 Marshall et al.

* cited by examiner

PINCH GRIP HANGER

CROSS REFERENCE TO RELATED APPLICATION

This is a Continuation-in-Part of U.S. application Ser. No. 10/076,790, filed Feb. 15, 2002.

FIELD OF THE INVENTION

The present invention relates generally to a pinch grip hangers, and more particularly pertains to a pinch grip hanger used for hanging pants and skirts for shipment to retailers and display of the same in a retail environment. The improved hanger has reduced depth, a greater jaw opening, a greater jaw length, and more constant spring force than prior art hangers.

BACKGROUND OF THE INVENTION

Consumer taste and fashion have dictated a desire for mass-produced, but well-fitted garments, which are distributed and sold throughout the United States. Large national retailers of clothing generally contract with a plurality of clothing manufacturers to produce uniform standardized clothing, which is essentially identical from batch to batch, even though manufactured by different entities. These manufacturers in turn produce the clothing at their own plants, or in many cases, subcontract the production of the garments to manufacturers based in the Far East, for instance, in Hong Kong, Taiwan, Singapore and South Korea.

In the retail clothing industry clothing is typically suspended from hangers at the point of purchase. Such hangers are often inexpensive ship-on types and under prevailing garment-on-hanger programs, the garment is shipped from the manufacturer to the retailer while suspended from a hanger. Traditional garment-on-hanger pant and skirt hangers used spring clips that were manually pushed into a locking position to secure the pants or skirts to the hanger. In these hangers, a steel retaining clip was manually clamped over a clam shell garment grip to secure the garment. Use of the hangers in this device required a manual operation to slide the steel clip over the clam shell to close the retention clip on the garment.

However, these hangers were not popular as the physical force needed to close a hanger on a thick waist band could result in increased time and labor costs to load the hanger and complaints of inadvertently broken finger nails were common. For these reasons, pinch grip hangers have become popular in recent years. However, pinch grip hangers generally have greater depth than clip hangers, resulting in fewer garments per rod or per loop when shipping the garments, and a tendency to inadvertently drop the garments when subjected to unexpected shipping loads, as adjacent hangers impact one another and open one or more of the pinch grips. Inadvertent opening of the pinch grips can also occur in a retail store environment, as customers push the garments to one side to better view a garment of interest. Moreover, the length of the pinch grip was not sufficient to grip the waistband of certain garments, so that on impact, the grip would engage the waistband of a garment, causing the garment to easily slip out of the pinch grip hanger. Various guards have been proposed in the prior art to prevent the inadvertent opening of the pinch grips, but these guards also contribute to increased depth for the product.

DISCUSSION OF THE PRIOR ART

U.S. Pat. Nos. 4,446,996 and 4,826,056 are typical of early pinch grip hangers intended for mass merchandise market that used open and unprotected pinch grips. Frequently, these pinch grips would open and drop the garment to the floor if the pinch grips were pressed together, as might happen as a result of over crowding a display rod with too many garments, or even as a result of a customer pushing garments aside to better view a single garment of interest.

U.S. Pat. Nos. 4,194,274 and 5,082,153 are typical of the clamping hangers referred to above, which used a steel spring to secure the jaws of a clam shell clip together. These hangers, while relatively secure in clamping the garment, required significant physical force to close the clam shell clip of the hanger on a thick waist band. This could result in increased time and labor costs to load the hanger and complaints of inadvertently broken finger nails from retail store personnel were common, with occasional repetitive stress injury complaints from factory workers who were loading thousands of garments a day into hangers of this style.

U.S. Pat. No. 3,946,915, illustrates a prior art hanger with the fixed jaw of a pinch grip hanger offset to the rear of the hanger support bar, and a guard member extending outwardly to protect the moveable jaw when the hangers are pressed together. The design of the pinch grip utilized in this device results in a relatively thick hanger with a modest jaw opening.

U.S. Pat. Nos. 5,400,932, 6,019,261 and 6,021,933 are typical of more recent hanger designs that incorporate a guard to prevent the inadvertent opening of pinch grips during shipment. In these designs, the pinch grip with a fixed and a moveable jaw is used, with the fixed jaw integrally molded with the hanger support bar. One or more guard members then extend outwardly from the support bar to protect the moveable jaw from inadvertent actuation. While these designs achieve their intended effect, they are relatively thick, reducing the number of hangers that can be shipped on any given support bar. Further, as a result of the pinch grip design utilized, the maximum opening of the pinch grip is limited.

U.S. Pat. No. 4,009,807 is a prior art pinch grip hanger having the pinch grip offset from the center line of the support bar of the hanger. However, in this design, pressing two adjacent hangers together would result in opening the pinch grip, and release of the garment.

U.S. Pat. Nos. 5,516,014 and 5,785,216 disclose the use of a thermoplastic rubber, sold under the name Kraton, by Shell Oil Company. The thermoplastic rubber provides a non-slip grip for the hanger.

The above prior art pinch grip hangers use metal springs with a relatively constant spring rate, which means the pinch grip requires progressively greater force to open as the jaws are opened, i.e., the further the jaws are opened, the greater the bias loading exerted by the spring. This makes it difficult to fully open the jaws of some of these hangers when it is necessary to insert a relatively thick waistband.

These prior art pinch grip hangers are loaded manually, since both pinch grips are normally biased to a closed position by a spring and both must be opened to load a garment into the grips. At the present time this requires an operator to perform four steps. Using one hand the operator must open the first pinch grip and then using the other hand to suspend the garment, one side of the garment is placed in the grip. This process is then repeated for the other pinch grip. With the second pinch grip the operator must also simultaneously tension the garment between the clips, and since both hands are already occupied, the tensioning step may require additional manual movements. At a minimum, four manual steps or movements are required for each garment that is loaded, resulting in relatively high labor costs for loading the garments.

These prior art hangers are difficult to automate as they are not designed to stack load in a magazine, and they frequently have a single pair of projecting high points which causes the hangers to not stack evenly in a magazine. Further, the high points can result in the hanger snagging on the next to be fed hanger in an automated feed mechanism.

SUMMARY OF THE INVENTION

It is an object of the invention to provide an inexpensive secure and protected pinch grip hanger of reduced width to allow greater density of garments during shipment.

It is another object of the invention to provide a secure and protected pinch grip hanger of reduced width having a relatively wide jaw opening to facilitate insertion of garments.

It is another object of the invention to provide a secure and protected pinch grip hanger of reduced width that has a multi-stage spring to provide a relatively constant bias force as the jaws are opened, thus minimizing the total force necessary to fully open the pinch grip.

It is another object of the invention to provide a secure and protected pinch grip hanger of reduced width having a relatively long grip to facilitate insertion of a waistband of a garment above the gripping members.

It is another object of the invention to provide a secure and protected pinch grip hanger of reduced width that is particularly adapted for magazine feed and the automated loading of garments.

These and other objects of the invention are met in an improved pinch grip hanger having a hook and a support bar suspended from said hook with the support bar defining a horizontal axis. A pair of pinch grips are provided, with a pinch grip mounted on either end of the support bar. Each of the pinch grips define a first depth in a direction perpendicular to said horizontal axis. Each of the pinch grip has a first and a second pinch grip jaw, with the first jaw mounted on and integrally molded with the support bar at a fixed location. The second jaw is pivotally mounted on said first jaw and spring biased into engagement with said first jaw. The second jaw has a user engagement portion extending upwardly from the pivotal mounting, and a garment engaging portion extending downwardly from said pivotal mounting to a distance that facilitates engaging a garment below the waistband. The user engagement portion enables a user to open the pinch grip for insertion or release of a garment in said pinch grip. A multi-stage spring encompasses the first and second jaws and bias the pinch grip to a closed position to clamp and suspend a garment between said first and second pinch grip jaws in normal use. The hanger further includes an offset mounting portion securing the first jaw of the pinch grip to the horizontal support bar, such that said first pinch grip jaw is offset from the centerline of the hanger by approximately one half the distance of the first dept, thereby reducing the depth of the hanger in normal use.

The pinch grips are protected in two ways. First, an outwardly extending member is mounted on at least one side of the pinch grip, extending from a rear plane of the pinch grip in a direction perpendicular to said support bar to define a fixed guard for the user engagement portion of the second jaw. The fixed guard extending perpendicularly from said rear plane of said pinch grip beyond said user engagement portion when said pinch grip has a garment secured therein, such that when two or more improved pinch grip hangers are suspended from their respective hooks with garments clamped in their respective pinch grips, the fixed guard on the first of two hangers will engage the rear plane of the pinch grip of the second of said two hangers when the hangers are pressed together, thereby preventing accidental actuation of the pinch grips and release of the garments. Second, a pair of arches are formed on the pinch grip jaws, below the pivot axis of the jaws, such that when two or more pinch grip hangers are suspended from their respective hooks with garments clamped in their respective pinch grips, the arch or guard portion on the second jaw of the first of two hangers will engage the rearward facing arch formed on the back of the first pinch grip jaw of the second of said two hangers. Since the engagement is below the pivot axis of each of the pinch grips, when the hangers are pressed together, the fixed arch and the moving arch engage each other, not the user engagement portion, thus preventing accidental actuation of the pinch grips and release of the garments.

The second or moveable pinch grip jaw is mounted on posts which extend outwardly from the first pinch grip jaw, through the center axis of the hanger. The moveable pinch grip jaw is secured to the fixed pinch grip jaw by a multi-stage spring which wraps around both arches. The arches are contoured, but the spring is formed with relatively linear engagement portions. When the spring initially engages the plastic arch to be clamped, the effective length of the spring is relatively short, and the spring effect exerted is relatively stiff. As the jaw is opened, it opens to disengage sequential linear portions of the spring along the plastic arch, thus increasing the effective length of the spring. Thus the fixed spring constant, and the relative increasing bias of the spring as it is progressively bent, is offset by the increasing length of the leverage of the spring against its respective plastic member, so that as the spring is biased to its fully opened position, the spring constant is now biased against a longer leverage, making it easier for the user to fully open the jaws of the pinch grip.

BRIEF DESCRIPTION OF THE DRAWINGS

FIG. 3(*b*) is a diagrammatic and perspective view of the inside of the fixed jaw of the pinch grip of the present invention.

FIG. 3(*c*) is a diagrammatic and perspective view of the inside of the elongated moveable jaw of the pinch grip of the present invention.

FIG. 3(*d*) is a diagrammatic and perspective view of the inside of the elongated fixed jaw of the pinch grip of the present invention.

FIG. 6(*b*) is a side view of the pinch grip of the present invention, particularly illustrating the relationship of the jaws and the spring when the pinch grip in normal operation, as for example in gripping a garment.

FIG. 6(*c*) is a side view of the pinch grip of the present invention, particularly illustrating the relationship of the jaws and the spring when the pinch grip is wide open.

FIG. 6(*d*) is a side view of the elongated pinch grip of the present invention, particularly illustrating one embodiment of the elongated pinch grip when the pinch grip is closed.

FIG. 6(*e*) is a side view of the elongated pinch grip of the present invention, particularly illustrating a second embodiment of the elongated pinch grip when the pinch grip is closed.

FIG. 6(*f*) is a side view of the elongated pinch grip of the present invention, particularly illustrating a third embodiment of the elongated pinch grip when the pinch grip is closed.

FIG. 10(*b*) is an front view of the multi-stage spring illustrated in FIG. 10*a*.

FIG. 12(*b*) illustrates a top view of the size indicators of FIGS. 12(*a*) and 12(*c*).

FIG. 13(*b*) illustrates the enlarged view of the web of FIG. 13*a* with a size indicator secured thereon.

FIG. 14(*b*) illustrates the first web and the size indicator of FIG. 14(*a*) wherein the pivoting latch is being pivoted to release the size indicator therefrom.

DETAILED DESCRIPTION OF THE PRESENT INVENTION

Figure 1:
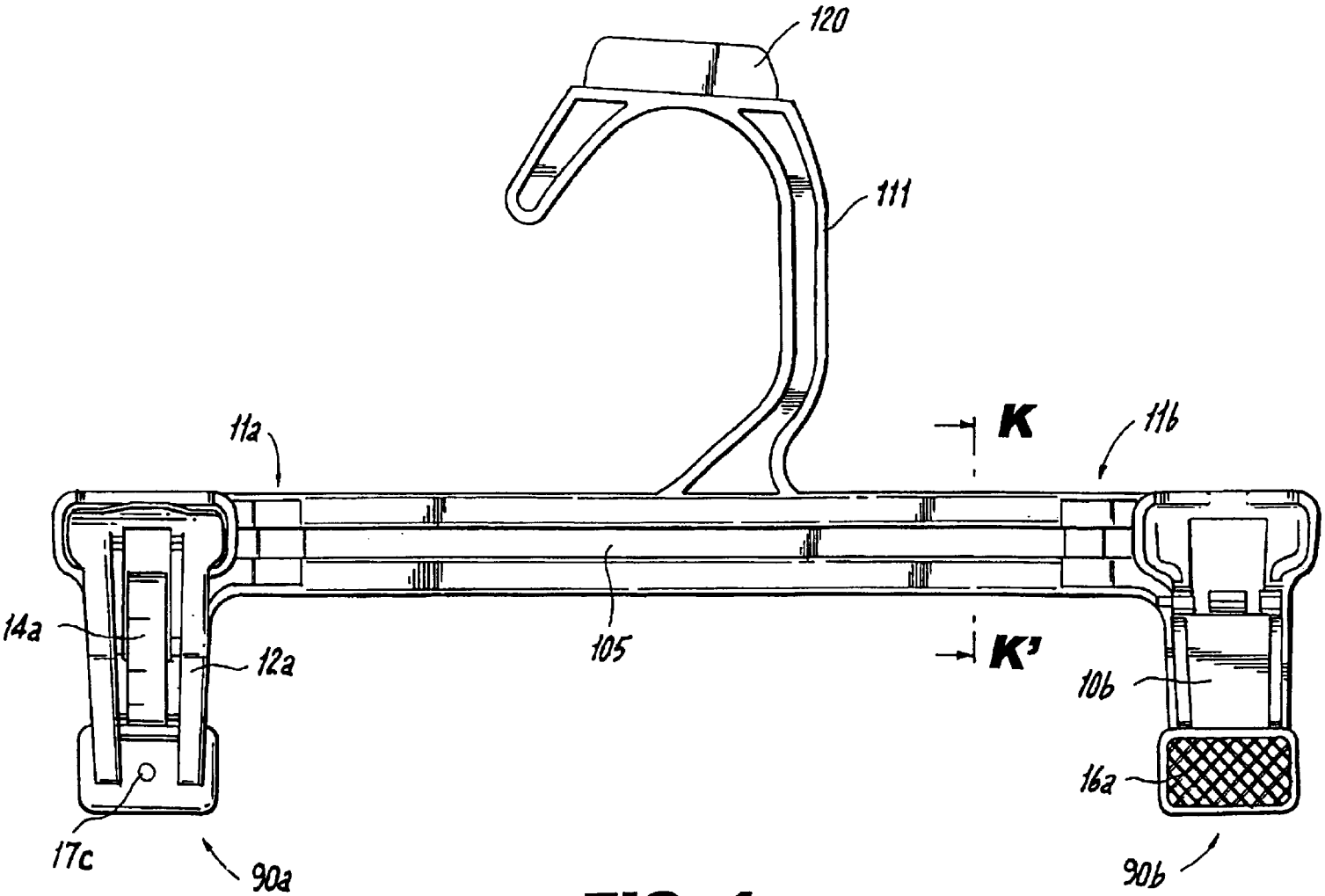
FIG. 1 is a plan view of the improved pinch grip hanger of the present invention illustrating a hanger with an integrally formed plastic hook, adapted to receive a removable size indicia. One of the pinch grips has the spring and moveable pinch grip jaw removed for the purpose of illustrating the device.
Figure 2:
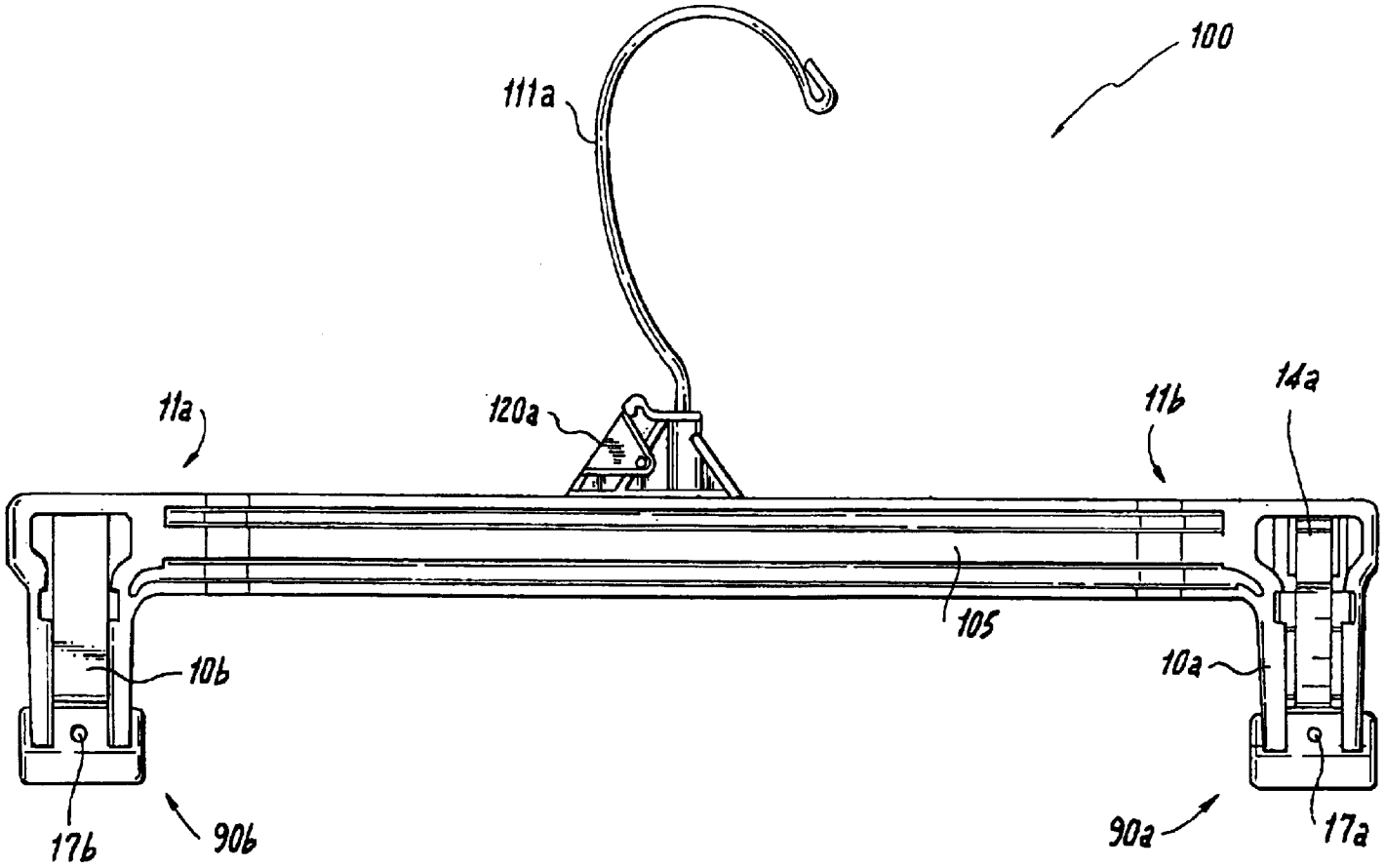
FIG. 2 is a plan view of the opposite side of the improved pinch grip hanger of FIG. 1 illustrating a hanger with a wire hook. The hanger is adapted to receive a removable size indicia. One of the pinch grips has the spring and the moveable pinch grip jaw (not visible from this side) removed to provide consistency with the illustration of FIG. 1.

The improved pinch grip hanger 100 of the present invention is illustrated in plan view in FIGS. 1 and 2 with FIG. 1 being a plan view of the front side of the, hanger, and FIG. 2 being the reverse side. The improved pinch grip hanger 100 is molded of plastic with a center support bar 105 in an upwardly extended hook member 111. As illustrated in FIG. 1, the hook member 111 is formed of plastic and integrally molded with the support bar 105. As illustrated in FIG. 2, the hanger is fitted with a wire metal hook 111A that is swivel mounted in the central support bar 105 and a manner well known in the art. Hook member 111, as illustrated in FIG. 1 includes an upstanding flange member 120 that is adapted to receive a size indicia for a characteristic of the garment suspended in the hanger. The size indicia may be permanently affixed to the hook 111 as taught by U.S. Pat. No. 5,604,975 or maybe releasably secured as taught by U.S. Pat. No. 5,794,363. Both of these patents are assigned to the assignee of the present invention, and the disclosures of both patents are incorporated herein by reference thereto.

As illustrated in FIG. 2, the present invention may also be fitted with at pivoting flange 120A to receive a side sizer in the matter taught in U.S. Pat. No. 6,260,745, also assigned to the assignee of the present invention. The disclosure of this patent is also incorporated herein by reference thereto.

As illustrated in FIG. 1, the pinch grip hanger includes a first 90*a* and second 90*b* pinch grip positioned on either end of the support bar 105. In FIGS. 1 and 2, the moveable pinch grip jaw and spring, to be described later, have been removed from pinch grip 90*b* for the purpose of illustrating the invention.

Figure 11:
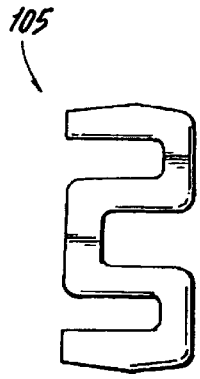
FIG. 11 is a cross section of the hanger support bar 105 taken along section line K–K' in FIG. 1.

The central support bar 105 is formed of a square M-shaped cross-section, further illustrated in cross section in FIG. 11 which provides exceptional strength along the vertical axis of the hanger. The cross section of FIG. 11 is taken from section line K–K' in FIG. 1. Each of the pinch grips 90*a* and 90*b* include a first and second pinch grip jaws with the first jaw members 10*a* and 10*b* being integrally molded with the support bar 105. As will be hereinafter discussed in greater detail, the fixed jaw members 10A and 10B are offset from the center axis of support bar 105 with an offset mounting portions 11*a* and 11*b* that enable the fixed jaws 10*a* and 10*b* to be mounted behind the rear plane of the central support bar 105. The second jaw members 12*a* and 12*b* (12*b* is omitted in FIG. 1) are pivotally secured to the first jaw members at a pivot mounting, by a spring member 14, as will be hereinafter discussed in detail. It should be noted that spring member 14*b* is omitted in FIG. 1 and FIG. 2.

Figure 3A:
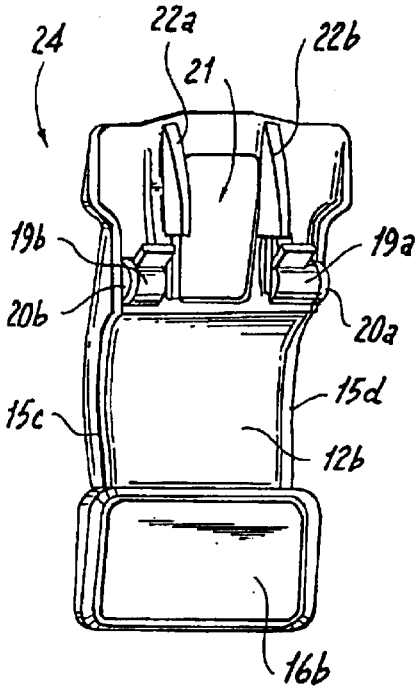
FIG. 3(*a*) is a diagrammatic and perspective view of the inside of the moveable jaw of the pinch grip of the present invention.
Figure 3B:
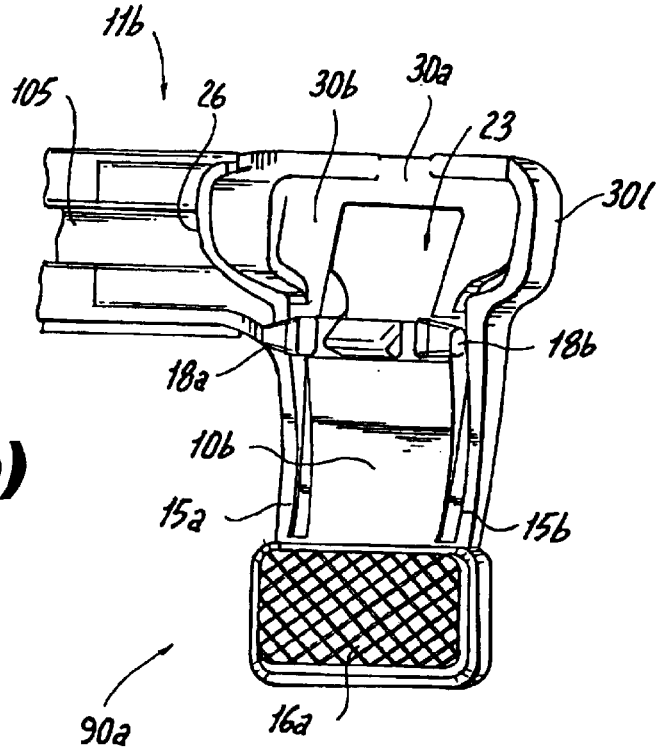
Figure 3C:
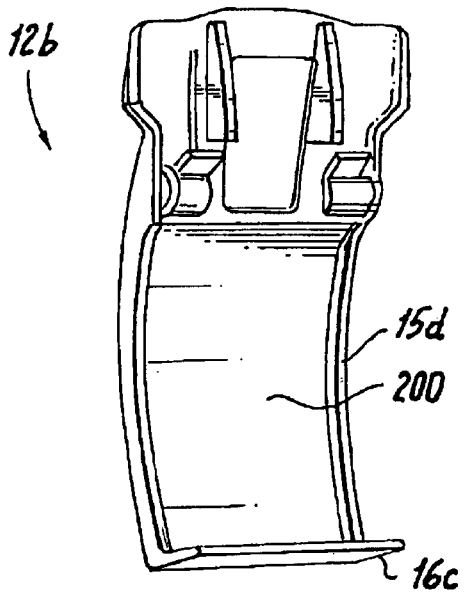
Figure 3D:
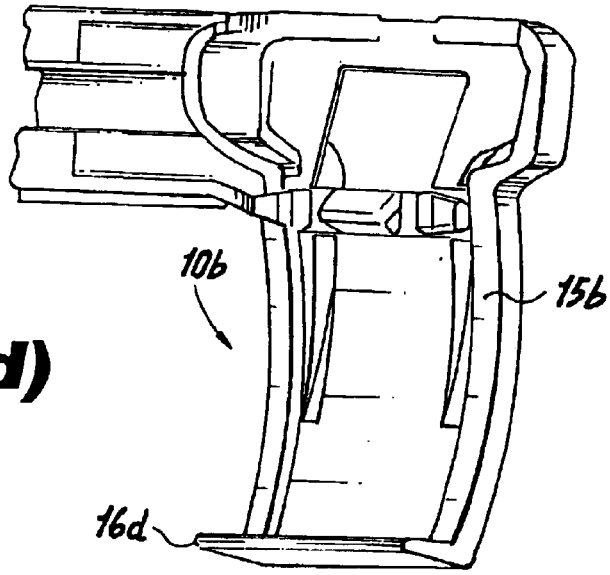

The construction of a typical pinch grip is more fully illustrated in FIGS. 3*a*–3*d*. FIG. 3*b* is a perspective view of the first fixed jaw 10*b* and FIG. 3*a* is a perspective view of the second movable jaw 12*b*, which jaws together form the single pinch grip 90*b*. FIG. 3*c* is a perspective view of the elongated first fixed jaw 10*b* and FIG. 3*d* is a perspective view of the second movable jaw 12*b*, where jaws 10*b*, 12*b*, together, form the single elongated pinch grip 90*b*. Each of the pinch grip jaws define garment engaging areas at 16. In FIGS. 3*c* and 3*d*, the garment engaging areas 16 are positioned to engage a garment below the waistband even when the garment has a relatively wide waistband. The moveable second jaw member of FIG. 3*a* also defines a user engagement portion 24 used to open the pinch grip.

The fixed jaw 10*b* is formed with an arch with a pair of u-shaped molded channels 15*a* and 15*b* which strengthen the fixed jaw and provide additional strength to resist deflection in the lateral direction. Likewise, the moveable jaw 12*b* is formed with a similar pair of molded u-shaped channels 15*c* and 15*d* for the same purpose.

Each of the jaws maybe fitted with a molded non-slip pad 16*a* as illustrated in FIGS. 3*a* and 3*b*, or maybe molded with teeth as more fully illustrated in FIGS. 3*c*, 3*d*, 6*d*–6*f*, and 7.

Figure 6C:
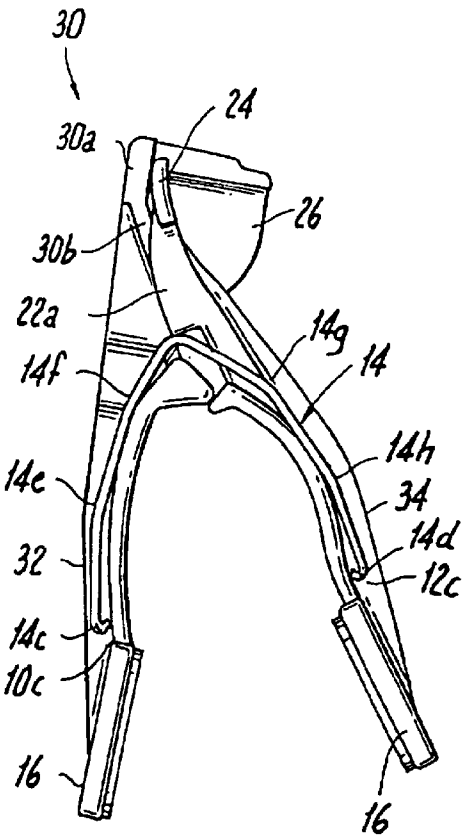
FIG. 6(*a*) is a side view of the pinch grip of the present invention, particularly illustrating the relationship of the jaws and the spring when the pinch grip is closed.
Figure 6B:
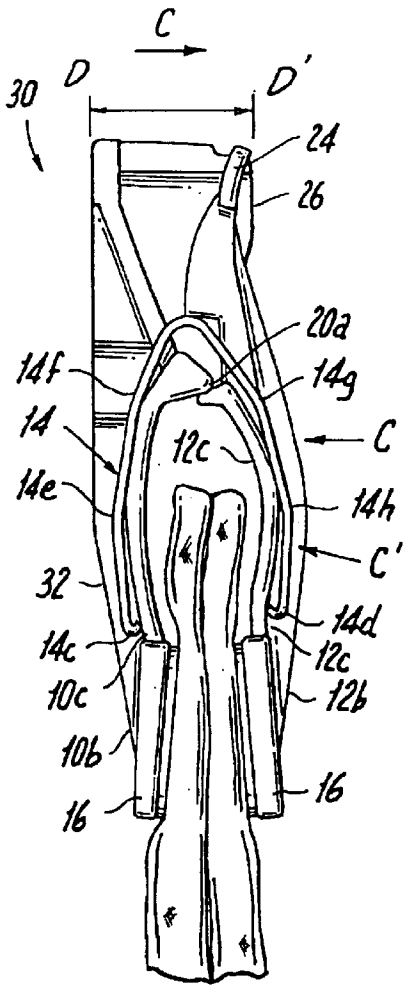
Figure 6A:
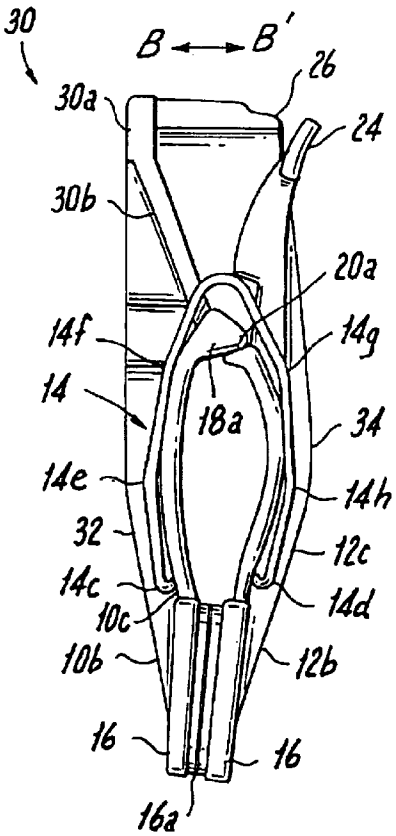
Figure 6F:
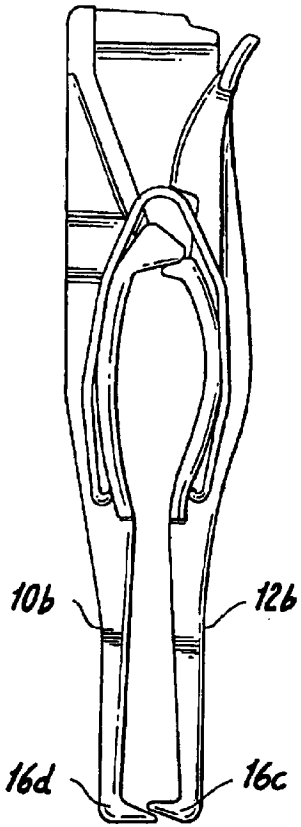
Figure 6E:
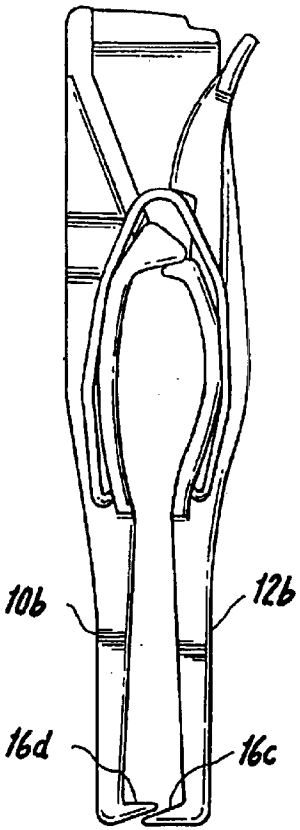

In a first embodiment of the invention, integrally molded teeth are used to engage the garment. As illustrated in FIGS. 3*c*, 3*d*, 6*d*–6*f*, and 7, the teeth 16*c* and 16*d* are integrally molded onto the pinch grips 10*b* and 12*b*. Although only one set of teeth is illustrated in FIGS. 3*c*, 3*d*, and 6*d*–6*f*, a plurality of teeth can exist on either or both the movable jaw 12*b* or the fixed jaw 10*b*, as illustrated in FIG. 7.

The teeth 16*c*, 16*d* are very effective in retaining garments within the hanger. The increased retention power of the teeth 16*c*, 16*d* is derived from channeling the full retention power of the spring member 14*a* or 14*b* through the narrow contact area of the teeth 16*c*, 16*d*, as compared to alternative gripping surfaces. Accordingly, the teeth 16*c*, 16*d* of the elongated pinch grip hangers are particularly suited for rugged and heavy garments such as denim jeans with wide waistbands. Garments made of rugged material have relatively more resiliency than, for example, garments suitable for casual or formal wear. The teeth 16*c*, 16*d* can compress garments made from rugged material without there being the concern that the teeth 16*c*, 16*d* will leave noticeable impressions at the locations where the teeth 16*c*, 16*d* engage the garment.

The teeth 16*c* on the movable jaw 12*b* preferably have the same length and width of the teeth 16*d* on the fixed jaw 10*b*, although segmenting either or both of the teeth is possible without affecting the operation of the teeth 16*c*, 16*d*. The teeth 16*c*, 16*d* are designed such that when the pinch grip jaw is closed and not engaging a garment, the outer width of the pinch grip hanger at the teeth location, illustrated as "W" in FIG. 6*d*, is less than half an inch.

Figure 6D:
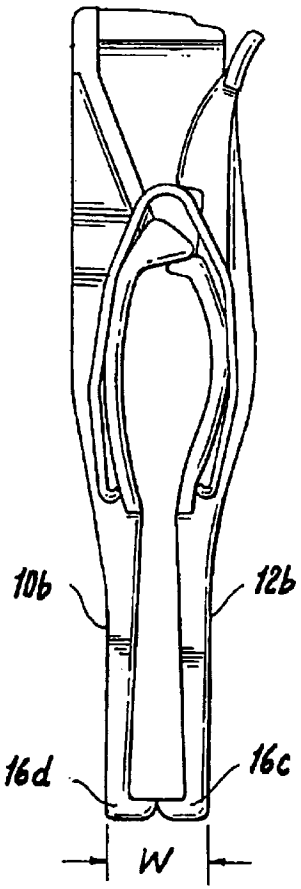
Figure 7:
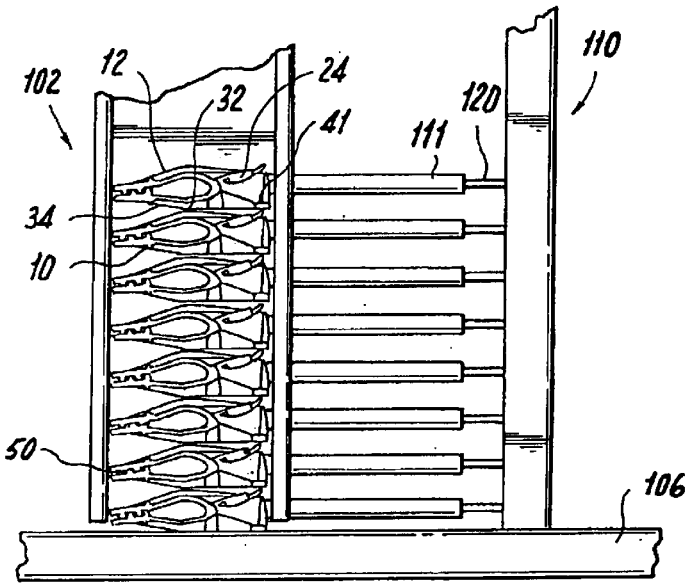
FIG. 7 is a side view of a plurality of the improved pinch grip hangers of the present invention illustrating the plurality of hangers in a magazine.

In a preferred embodiment, the teeth are preferably formed so that, when the jaw is closed and not in use, the tip of the bottommost tooth 16*d* on the movable jaw 12*b* meets the tip of the bottommost tooth 16*d* on the fixed jaw 10*b*, as illustrated in FIG. 6*d*. In an alternative embodiment, as illustrated in FIG. 6*e*, the teeth are preferably formed so that, when the jaw is closed and not in use, the tip of the bottommost tooth 16*c* of the movable jaw 12*b* is below the tip of the bottommost tooth 16*d* of the fixed jaw 10*b*. In another alternative embodiment, as illustrated in FIG. 6*f*, the teeth are preferably formed so that, when the jaw is closed and not in use, the tip of the bottommost tooth 16*c* of the movable jaw 12*b* is above the tip of the bottommost tooth 16*c* of the fixed jaw 10*b*. In yet an alternative embodiment, the teeth 16*c*, 16*d* are preferably formed as a juxtaposed array, as illustrated in FIG. 7.

As will be more fully described with respect to FIGS. 3*c* and 3*d*, the first pinch grip jaw is elongated by a section 200. The elongation section 200 extends the length of the pinch grip by at least the length of a waistband of a garment such as a pair of pants. For example, the typical waistband on a pair of pants has a length that is one inch or less. Accordingly, the length of the elongation section 200 is approximately one inch. Further, the elongation section 200 is essentially linear, as illustrated in FIGS. 6*d*–6*f*.

The use of the section 200 allows the pinch grip jaw to grip clothing below a waistband. Gripping clothing below a waistband is beneficial because the waistband is often accompanied with additional bands of fabric, making the waistband area the thickest area of the garment. Gripping the garment below the waistband area thus effectively traps the garment within the pinch grip structure. In comparison, prior art pinch grip hangers gripped the garment on the waistband, and very frequently the friction coefficient of the cloth material was insufficient to hold a heavy garment, with the result that the garment tended to slip out of the grip of the pinch grip hanger in response to an impact on the grip, or sudden movement of the grip. Once the garment began to slip, there was no structure to stop the garment from falling on the floor.

A second embodiment of the invention uses non-slip pads rather than teeth to genage the garments. When non-slip pads are used as the garment engaging means, the non-slip pads 16*a* are formed from a thermoplastic rubber such as Raplan, or the Kraton family of materials manufactured by Shell Oil Company. This material has a high coefficient of friction when engaging a fabric, and is durable enough to maintain pad integrity during repeated clamping cycles. The pads 16*a* are post molded by injection molding through openings 17*a* and 17*b* in the fixed jaw and openings, and openings 17*c* and 17*d* in the moveable jaws into corresponding recesses on the garment engagement side, such as recess 16*b* in FIG. 3*a*. As illustrated in FIGS. 1 and 3*b*, the pads are also lightly textured to enhance the non-slip grip on fabric. To facilitate the retention of the pad in the recess, an amount, preferably 15%, of the hanger host plastic material may be added to the thermoplastic rubber prior to molding the pad. Depending on the host plastic used to mold the hanger, the percentage of host material to be included will vary, and by way of example, a hanger molded of polypropylene will typically have from 10% to 20%, and preferably, approximately 15% polypropylene mixed into the thermoplastic rubber before molding. A higher percentage may be used, but the additional polypropylene begins to degrade the non-slip functionality of the pad. The hanger may also be molded of a blend of K-Resin and SNMA (styrene methyl methacrylate copolymer), wherein from 1% to 3% host material may be added, since the K-Resin acts as a binding host for the non-slip thermoplastic rubber. This combination will also adhere for most purposes with no host material added.

Figure 4:
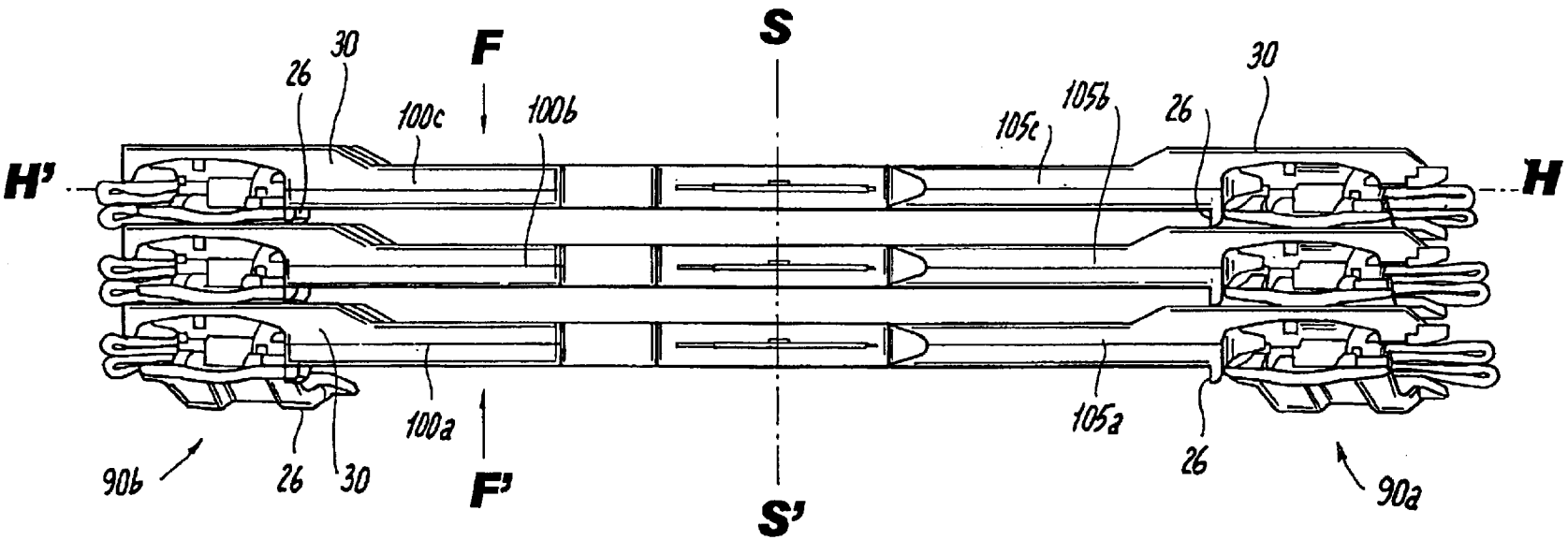
FIG. 4 is a top plan view of a plurality of hangers and garments as they might appear when nested together on a shipping or display rod.
Figure 5:
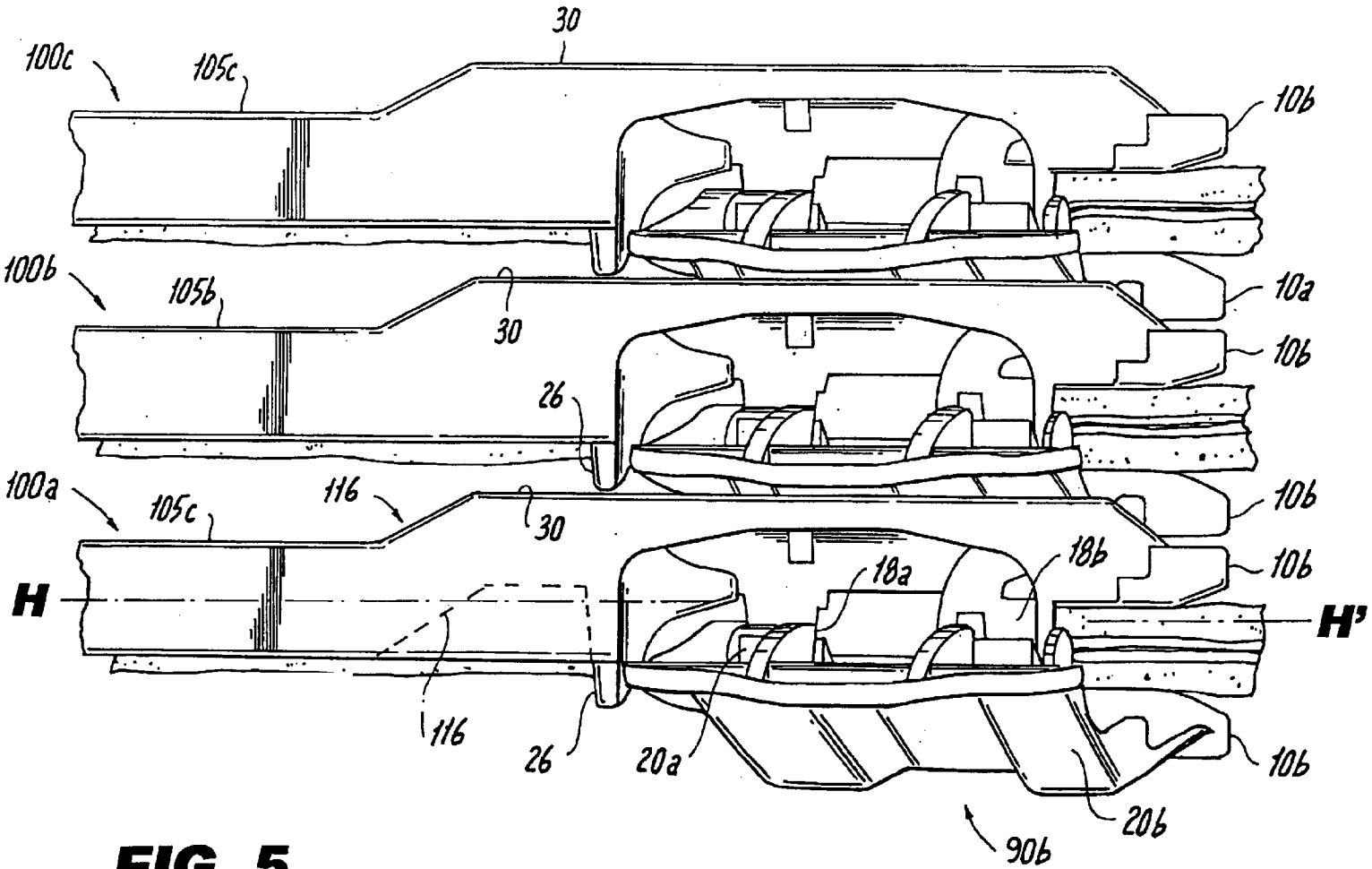
FIG. 5 is an enlarged view of one set of the pinch grips illustrated in FIG. 4.

As will be more fully described with respect to FIGS. 4 and 5, the first pinch grip jaw 10*b* is offset from the center axis of the center support bar 105 by means of the offset mounting portion 11B illustrated in FIG. 3*b*. The use of the offset mounting significantly reduces the overall thickness of the hanger, enabling greater density of hangers in shipment. Extending forwardly through the center axis and the center vertical plane of the hanger are pivot posts 18*a* and 18*b* which are received in sockets 19*a* and 19*b* formed on the moveable jaw 12*b*. Lateral movement of the second moveable jaw is constrained by several design features. The first factor is the use of flanges 20*a* and 20*b* which bound the outside of sockets 19*a* and 19*b* and prevent lateral shifting of the moveable jaw 12*b* on pivot posts 18*a* and 18*b*. Secondly, a fixed post 18*c* is molded in the fixed jaw, and extends forwardly through an opening 21 defined by the moveable jaw 12*b*. The moveable jaw also includes a pair of rearwardly projecting flanges 22*a* and 22*b* which provide dual functions for the moveable jaw. First, they strengthen and add rigidity to the upper user engagement portion 24 of the moveable jaw to prevent twisting and secondly, the outer surfaces of these flanges are closely matched to the side walls of opening 23 in the fixed pinch grip jaw to maintain consistent alignment with the fixed jaw throughout the pinch grip range of motion.

The pivot post 18*a* and 18*b* and the sockets 19*a* and 19*b* define a pivot axis for the pinch grip with the pinch grip having a garment engaging means 16 mounted below the pivot axis. The user engagement portion 24 extends upwardly from the pivot axis to enable the user to open the pinch grip for insertion of the garment between the garment engagement pads 16. The user engagement portion 24 also enables the user to open the pinch grip for release of the garment in the pinch grip. The first fixed jaw also includes a forwardly extending flange or guard member 26 which is mounted on the forward face of the fixed pinch grip jaw 10*b* and extends forwardly pass the center line of the hanger support bar 105 to prevent the accidental dislodgement of garments from the pinch grip when two adjacent hangers are inadvertently pressed together.

The operation of the guard 26 can be better illustrated in a comparison of FIGS. 6*a* and 6*b* which are cross sections through one of the pinch grips with FIG. 6*a* illustrating the jaws as they would appear in a closed position. The pinch grip jaws are illustrated in an operation position suspending a garment in FIG. 6*b*. As illustrated in FIG. 16*a*, the fixed jaw 10*b* is mounted on an offset behind the rear plane of the hanger bar 105 and the guard member 26 extends forwardly or perpendicularly to the plane of support bar 105 to a distance sufficient to cover the user engagement portion 24 of the second moveable jaw when the clip is in use suspending a garment. As illustrated in FIG. 6*a*, when the clip is closed and not in use, the user engagement portion 24 extends beyond the guard 26. As will be hereinafter described in greater detail with respect to FIG. 7, this extension provides one point of a four-point engagement plane for stacking the hangers in a magazine. Magazine feed of the hangers enables the improved pinch grip hanger of the present invention to be used in an automated hanger dispensing apparatus. As illustrated in FIG. 6*b*, the pinch grip has engaged a garment between the fixed and moveable jaws, and the user engagement portion 24 is now protected by guard member 26.

As described above, protection of the user engagement portion 24 is necessary in a pinch grip hanger to prevent inadvertent actuation of the pinch grip when two or more of the improved pinch grip hangers are suspended from their respective hooks and placed adjacent one another. Without the guard, if the hangers are pressed together by shipping loads, or eager shoppers, the pinch grip will be opened, allowing the garment to fall. The present invention avoids this problem in two ways. In the first way, the fixed guard 26 of the first hanger will engage the rear plane 30 of the pinch grip to the second of two hangers when the hangers are pressed together thereby preventing engagement of the user engagement portion 24 and accidental opening of the pinch grip and release of the garments. As noted earlier such inadvertent opening can occur in a retail store environment as customers push the garments to one side to better view a garment of choice or can occur in the shipping environment when unexpected shipping loads occur on the container or truck in which the garments are being transferred. When such loads are encountered, adjacent hangers may impact one another and open one or more of the pinch grips if the pinch grips are not protected.

The pinch grip illustrated in FIGS. 6*a* and 6*b* also has a second means for protecting against the inadvertent actuation of the pinch grip. The pinch grip is constructed with a pair of arches generally indicated at 32 and 34 in FIGS. 6*a* and 6*b*, which bow outwardly below the pivot axis defined by pivot post 18*a* and pivot socket 24*a*. When a garment is engaged and the pinch grip in use, as illustrated in FIG. 6*b*, the outward arch 34 of the second moveable pinch grip arm 12*b* extends outwardly beyond the user engagement portion 24 and will engage the arch 32 defined on the rear surface of the fixed pinch grip arm 10*b* when two adjacent garment hangers impact one another. However, since the impact occurs below the pivot axis defined by pivot post 18*a* and pivot socket 20*a*, any impact loading tends to close the pinch grip, rather than open it.

The plurality of hangers is illustrated in FIGS. 4 and 5 illustrate the manner in which the guard members 26 and the arch members 34 prevent the inadvertent actuation of the pinch grip. As illustrated in FIG. 4, three hangers 100*a*, 100*b* and 100*c* are suspended from a common suspension point illustrated by axis S–S'. In FIG. 4 each of the pinch grip hangers is suspending an article of clothing that is clamped in its respective pinch grips. As illustrated in FIGS. 4 and 5, each of the hanger support bars 105*a*, 105*b* and 105*c* define a center axis illustrated with respect to hanger bar 105*c* as H–H'. This axis is perpendicular to the suspension axis S–S' and may also be used to generate a vertical plane extending upwardly from the support bar 105 in a direction perpendicular to the plane of FIG. 4 and extending downwardly through the pinch grip 90*a* and 90*b* and parallel to the plane of the garment suspended by the hanger. FIGS. 4 and 5 illustrate an impacting engagement of the hangers wherein the rear surface 30 of each of the respective pinch grips provides an engagement point for the pinch grip guard 26. Thus, the user engagement portion 24 is protected from inadvertent actuation by guard member 26.

It should be noted that the offset placement of the pinch grips and the dimensioning of guard 26 and the user engagement portion 24 provide a hanger of reduced depth as will be hereinafter described. First as noted with respect to FIGS. 6*a* and 6*b*, the overall depth of the hanger is that as illustrated D–D'. Thus when shipping empty garment hangers the depth of the hanger is substantially reduced from that of the prior art devices. For example, in the hanger of the present invention, the depth D–D' is approximately ½ inch, while the depth of the prior art hangers is approximately ¾ inch. Thus each lineal foot of carton of new and unused empty hangers of applicants invention will contain 24 hangers, whereas the prior art will only stack 18 hangers in the same space. This significantly reduces the shipping cost for the hangers when shipping to garment manufacturers since garment hangers are typically shipped and billed in accordance with bulk in addition to weight.

As was described previously, and as can be seen in FIG. 6*b*, when a garment is engaged in the pinch grip of the hanger, the maximum depth of the hanger is from the outside of the arch 32 to the outside of the arch 34, is dependant upon the thickness of the folded material in the garment being shipped. The protective guard 26 begins to function when a ⅛ inch thick garment is being gripped by the pinch grip jaws 10*b* and 12*b*. At this level the distance between the outside of arch 32 and the outside of arch 34 is approximately ⅝ inch, still of reduced depth when compared to the prior art devices.

It should also be noted that the pinch grip of the present invention may also be opened to a wider dimension than the pinch grips of the prior art. For example, in the prior art hanger illustrated in U.S. Pat. No. 6,021,933, the plastic teeth utilized in this hanger begin to impede the insertion of any garment having a waistband thicker than ½ inch. When gripping a ½ inch thick object, the outside maximum dimension of the prior art pinch grip is approximately 1 inch. In contrast, and as illustrated in FIG. 6C, the pinch grip of the present invention can accommodate garments that are far thicker than ½ inch. Further, when engaging a ½ inch thick object, the maximum depth of the hanger is approximately ¾ inch. Thus a single lineal foot of shipping rod or display rod will support 16 hangers of the present invention having a garment with a ½ inch waistband gripped therein, while the prior art pinch grip hanger will only accommodate 12 hangers in the same space. This significantly increases the number of hangers in garments that may be shipped utilizing the pinch grips of the present invention.

As will be noted in FIG. 5, the hanger bar 105*c* illustrates in dotted hidden line illustration, the offset at 11*b* which mounts the fixed jaw 10*b* behind the rear plane of hanger bar 105*c* and behind the center axis H–H' of the hanger. As will be noted, the pivot post 18*a* and 18*b* extend through the center axis H–H', to provide a pivot axis forward of the center horizontal bar axis H–H'. The square M cross-section of center support bar 105 is carried or continued through the offset at 11*b* until merging with the fixed jaw as best illustrated in FIG. 3*b*.

As will be noted in FIG. 6*c*, the pinch grip of the present invention has an extraordinary opening for receiving material to be clamped. This opening is further enhanced in the elongated pinch grip hanger (not illustrated). Having a wide opening in the extreme open position facilitates insertion of clothing into the pinch grip when the pinch grip is used in an automatic dispensing machine that presents the hanger to the operator with the clips opened for insertion of a garment. The range of motion found in the improved pinch grip of the present invention is due to a combination of factors that are illustrated in FIGS. 3*b*, 6*a* and 6*c*. The rear wall 30 of the fixed clip includes several molded components, including a relatively short and planar upper wall 30*a* and an inwardly sloping diagonal wall 30B having or defining an opening 23 as best illustrated in FIG. 3*b*. It should be noted that channel 15*a* and 15*b* extend upwardly and are resumed on the opposite side of the pivot posts 18*a* and 18*b* to further strengthen the upper portion of the fixed grip. The first fixed pinch grip jaw also includes the guard member 26 on one side, and an outer shroud portion 30*d* on the opposite side, all of which components together contribute to strengthen the configuration of the fixed grip. As was noted earlier, when the moveable pinch grip jaw is actuated to its fully extended position as illustrated 6*c* the guide members 22*a* and 22*b* extend through the opening 23 defined in rear wall 30*b* to further assist in the prevention of any twisting or lateral motion of the pinch grip. The angle of wall 30*b* is essentially parallel to the angle of the moveable pinch grip jaw but offset therefrom by the depth of the arch at 34. The offset and the opening of the jaw is also determined by the length of the pivot post 18*a* and 18*b* which extend outwardly from the rear wall of the fixed clip past the center line axis of the center support bar 105. The pivot posts define a pivot axis for the moveable pinch grip jaw on the user side of the hanger center line H–H'. This combination of factors results in an advantageous and extremely wide opening of the pinch grip jaws as illustrated in FIG. 6*c*, which assists the operator in inserting garments into the pinch grip.

Figure 10A:
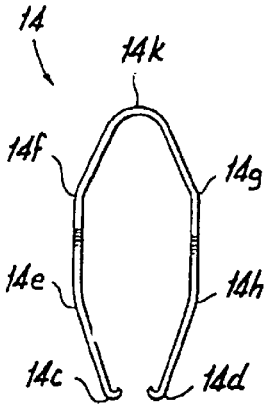
FIG. 10(*a*) is an end view of the multi-stage spring of the present invention.
Figure 10B:
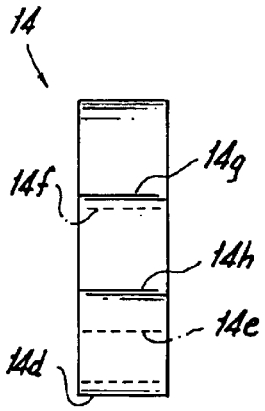

The present invention also includes a multi-stage spring 15 which will now be described with respect to FIGS. 6*a*–6*c* and 10*a*–10*b*. Spring 14 uses a combination of linear elements and a moving arched fulcrum to provide a relatively constant bias throughout the useful operating range of motion. It is noted that in the design of various spring members, each spring has a defined spring constant, and the force required to deflect the spring will vary according to the deflection of the spring and the length of the spring over which the force is applied. In the prior art pinch grip hangers, the further the moveable jaws are opened, the more difficult it is to overcome the bias exerted by the spring. The present invention uses the linear portions to be described and a moving fulcrum or spring engagement point to offset the increased bias resulting from increased deflection of the spring member. As illustrated in FIGS. 10*a* and 10*b*, the spring is a steel member and in a preferred embodiment was formed of steel A.S.S C1050 heat treated to 42–49Rc. The spring member was approximately 0.325 in width and 0.024 inches in thickness. The overall height of the spring was 1.134 inches and the width, when bent to the configuration as illustrated in FIG. 10*a* was 0.454 inches. The spring member 14 includes safety lock means formed by hook members 14*c* and 14*d* which define a nearly 180 degree return of the spring, and which engage internal retention ribs formed in the outer sides of the fixed and moveable jaw members of the pinch grip.

These safety locks serve two purposes. First, with the prior art hangers, it is possible to inadvertently dislocate or remove the moveable jaw, by pulling downwardly on the jaw. This can happen inadvertently by stress loading the garment in the grip in the downward direction, particularly if the moveable jaw has a stronger grip on the garment than the fixed jaw. This downward force may be exerted by the garment in response to a sudden change in direction of the container or truck in which the garment is being transported, or by a customer or sales person trying to pull the garment out of the pinch grip before the grip is fully open. This downward force is particularly noticeable where the elongated pinch grip hanger contains a garment having a distinct waistband, and a customer pulls downward so as to jam the waistband against the teeth 16*c*, 16*d* of the pinch grip jaw. Secondly, once the jaw of the prior art devices are dislocated, it is possible for the spring to fly off the pinch grip, and if this happens in a retail environment it may strike a customer or sales person. The returns, or hooks 14*c*, 14*d* enable the spring to be locked into the pinch grips via the rib configuration molded into the pinch grip jaws, as illustrated in FIGS. 6(*a*)–6(*c*). If a downward force is exerted on the moveable jaw, the retention rib 12*c* is caught by the hook 14*d*, locking the moveable jaw to the hanger. Downward force on the spring is resisted by the engagement of the spring at 14*e*–14*f* against the fixed pinch grip jaw 10*b*, and stopped entirely by the hook 14*c* as it engages retention rib 10*c*. As noted in FIGS. 6*a*–6*c* and FIGS. 10*a*–10*b*, the spring includes three linear portions on each side joined at the bight 14*k* with a radius of constant curvature of approximately R0.094.

When the spring is installed as illustrated in FIGS. 6*a*, and 6*d*–6*f*, it may be snug fitted or may be fitted or may be fitted so that it does not engage either the fixed jaw or the moveable jaw except at hook members 14*c* and 14*d* and the immediate adjacent linear portions 14*c*–14*e* and 14*d*–14*h*. The upper bite portion 14*k* extends through the opening 23 and over protrusion 18*c* through opening 21 in the moveable jaw to its mounting point as illustrated in FIGS. 6*a*, and 6*d*–6*f*. When free mounted, as illustrated as FIGS. 6*a*, and 6*d*–6*f*, the bight portion 14*k* may be shifted laterally in the direction of arrows B–B' a millimeter or two in either direction. Thus the initial opening of the spring begins with the longest possible throw or leverage on bight member 14*k* extending from 14*e* to 14*h*. However, shortly after opening, the moveable pinch grip jaw 12*b* pulls the spring forward in the direction of arrow C in FIG. 6*b* causing spring member 14 to engage the arched member 32 formed in the fixed jaw extending from 14*e* to 14*f*. Thus for the second stage of spring opening, the effective fulcrum of the spring runs from 14*f* through the bight 14*k* to a position between junctions 14*g* and 14*h*. The engagement between 14*g* and 14*h* along the arch member 12*c* is progressive, providing a moving fulcrum or anchor for the spring 14. As the pinch grip moves from the position illustrated in FIG. 6*b* to the position in FIG. 6*c*, the spring is progressively opened and the arch 34 is rolled away from spring 14 causing the operative portion of the spring to be progressively lengthened from 14*g* to 14*h* as the jaw is opened. When finally opened to the jaw opening illustrated in FIG. 6*c*, the spring is only making contact between 14*h* and 14*b* on the moveable jaw side. As noted above, contact is maintained at 14*f* against the rear wall of the fixed clip. Thus, the spring 14 may be held in the open position with the maximum leverage on the spring bight 14*k*. In the multi-stage spring of the present invention, the increase in stiffness due to increasing deflection of the spring is offset by a progressively longer mounting point for the spring, so that the user feels an apparent constant spring bias throughout the range of motion.

Figure 8:
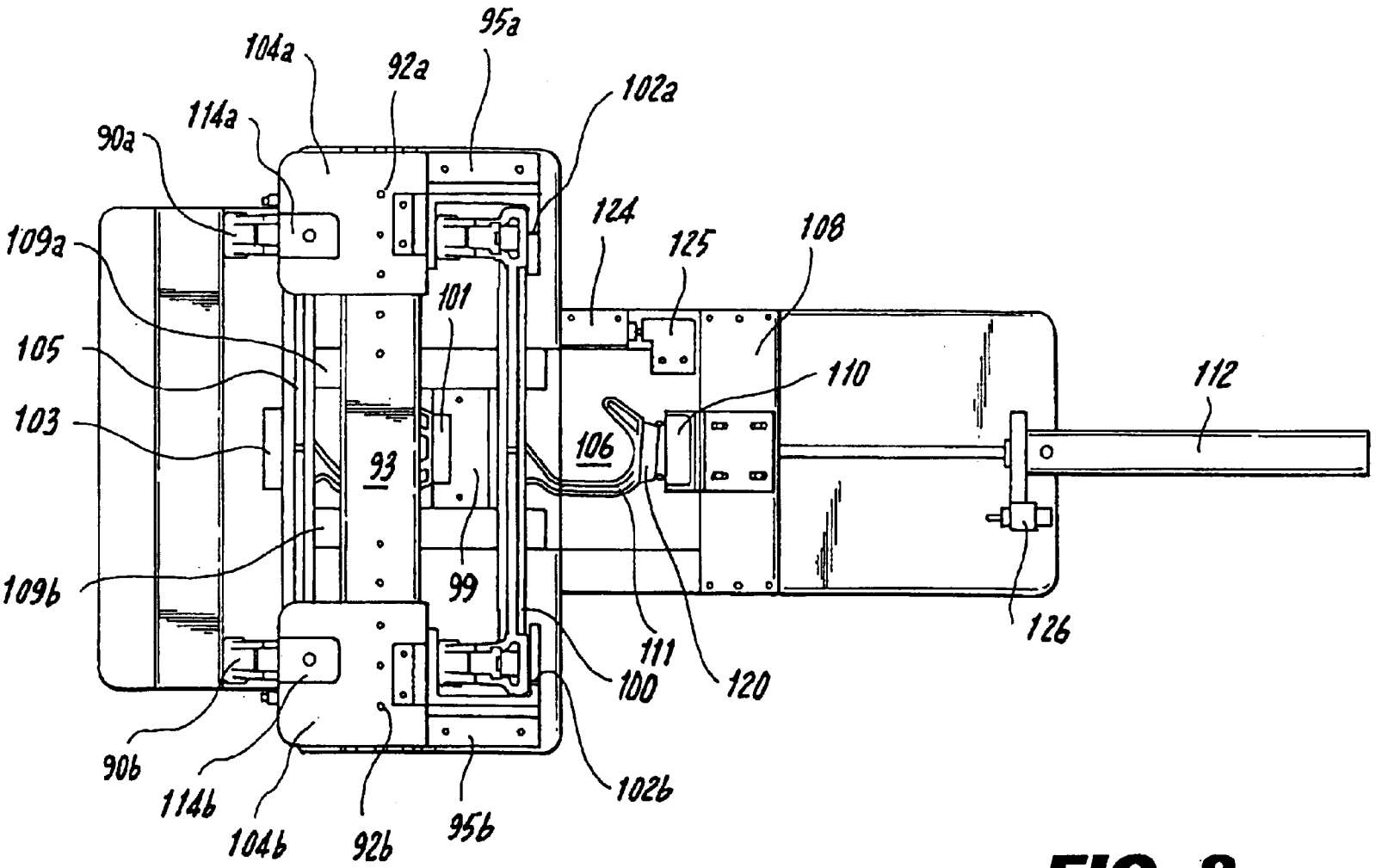
FIG. 8 is a plan view of a pinch grip hanger mechanism particularly adapted to automatically dispense the hangers of the present invention, illustrating a plurality of improved pinch grip hangers in the magazine and a pinch grip hanger extended to a garment loading position.
Figure 9:
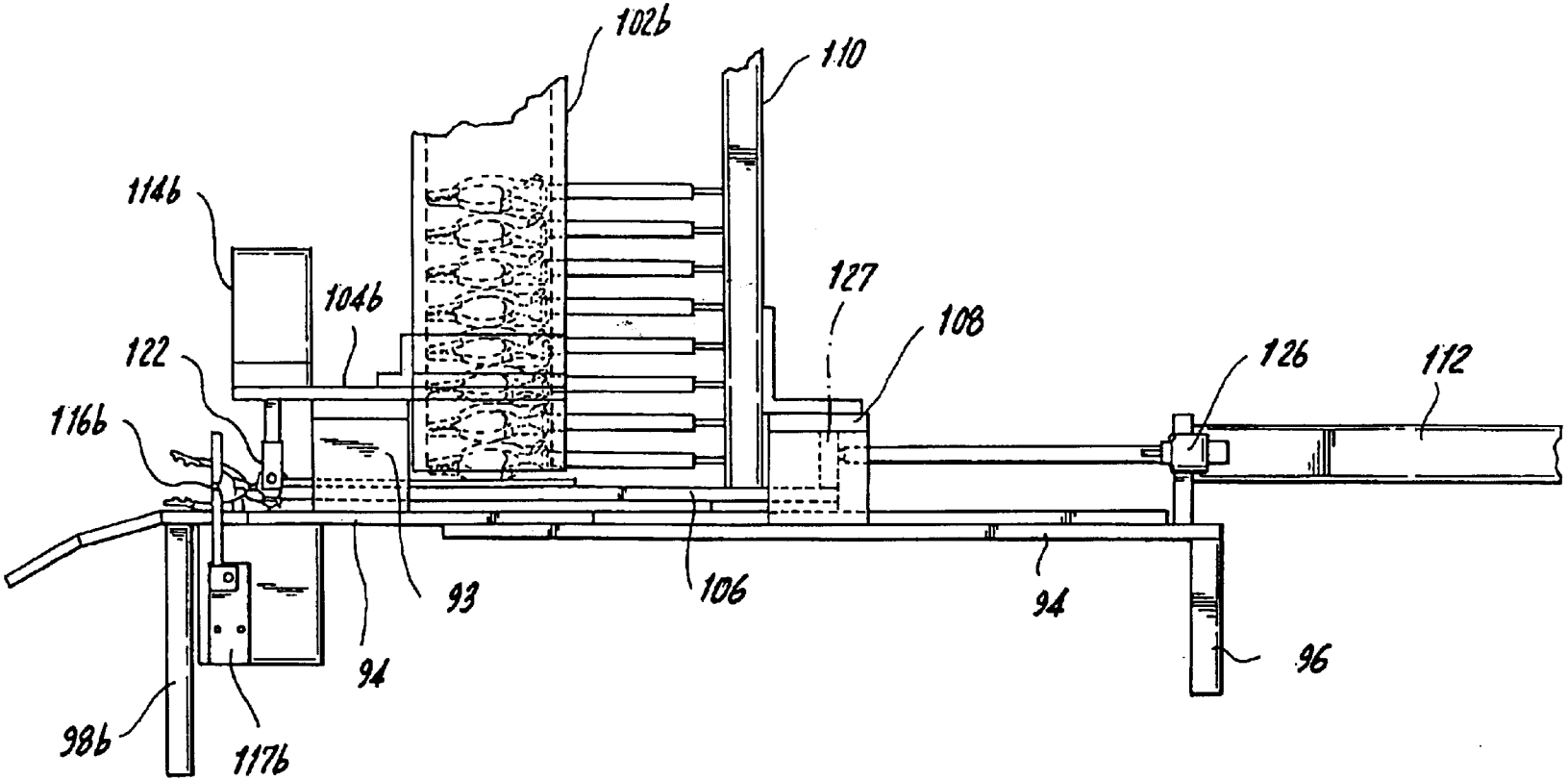
FIG. 9 is a side elevation view of the hanger mechanism, illustrated in FIG. 8 with pinch grip hangers in the magazine and a pinch grip hanger extended to the garment loading point.

FIGS. 8 & 9 illustrate a Pinch Grip Hanger Loading Mechanism particularly adapted to dispense the improved pinch grip hangers of the present invention. This mechanism is more fully described in U.S. Ser. No. 10/076,790, filed on Feb. 15, 2002, and assigned to the assignee of the present invention. The specification of this application is incorporated herein in its entirety, by reference thereto. Specifically, the mechanism promotes the safe and efficient operation of placing garments on pinch grip hangers for subsequent shipment and display.

As illustrated in FIGS. 8 & 9, a hanger magazine 102 is provided for vertically storing and loading a plurality of hangers 100 for the mechanism. The hangers are placed in the magazine 102 either singularly or as an attached group of hangers held together by a clip (not illustrated). The magazine includes a pair of upwardly extending receptacles 102*a*, 102*b* that are spaced above a main base 94, as best illustrated in FIG. 9. When hangers are loaded into the magazine, each hanger is oriented flat to the horizontal main base 94 with the clip portion of the hanger having its opening side facing the operator.

The magazines 102*a*, 102*b* are adjustably suspended above main base 94, and attached to intermediate base members 104*a*, 104*b* by means of brackets 95*a*, 95*b*. Pinch grip ram cylinders 114*a*, 114*b* are used to open the hanger pinch grips, and are also attached to base members 104*a*, 104*b*. Intermediate base members 104 are supported above main base 94 by means of inverted unshaped support bracket 93. The brackets 95*a*, 95*b* suspend the magazines 102*a*, 102*b* from the base members 104*a*, 104*b*, so that the lower portions of magazines 102*a*, 102*b* are elevated a defined distance above main base 94, as will be hereinafter discussed in detail. The main base 94 is supported by legs 98*a*, 98*b* and 96, which together provide a stable platform for the device and allow the device to be located at an elevation and location convenient to the operator.

The distance between base members 104*a* and 104*b* can be laterally adjusted on support 93 to allow various sizes of hangers 100 to be used in the mechanism. The base members 104 are adjusted by means of adjustment holes, two of which are identified at 92*a*, 92*b*. This enables magazines 102*a*, 102*b* and ram cylinders 114*a*, 114*b* to be moved into proper positions on either side of a centerline axis of the mechanism for use of the mechanism with various hanger lengths or sizes. In a preferred embodiment of the mechanism, the centerline axis is defined by the reciprocal movement of the push plate 106.

The push plate 106 is designed so that other hangers in the magazine 102 are retained in the magazine, and do not snag on the push plate 106 or otherwise leave the magazine when the push plate is in motion. The feed mechanism is a "slice feeder" in which the push plate 106 reciprocates back and forth under the magazine 102 and appears to be slicing off a single hanger 100 with each reciprocation. The dimensions and position of the push plate 106 with respect to the magazine 102 may be adjusted so that the device can accommodate a variety of hanger thickness, or alternately the device may utilize matched sets of magazines and plates, with each set appropriate for a specific hanger design. In operation, the next hanger in the magazine 102 is only released from the magazine 102 when the push plate has fully reciprocated to its rearward position. As the push plate 106 is retracted under the magazines 102, a single hanger 100 is released from the magazine and drops onto main base 94. The bottoms of magazines 102 are adjusted to be approximately one hanger thickness above the main base 94. As the push plate begins its cycle of operation, the push plate 106 reciprocates forwardly to engage the hanger 100 on main base 94. As illustrated in FIG. 8, the hook of the hanger is not initially engaged, as it falls into a cut out portion in the push plate 106 that extends between two hanger engaging arms 109*a* and 109*b*. As the push plate 106 advances, the engaging arms 109*a*, 109*b* engage the horizontal support bar 105 of the hanger 100, and begin to advance the hanger towards the operator. Only a single hanger is advanced at a time, since the dimensions of the slot below the magazine and the push plate 106 are too close to allow a subsequent hanger to be released.

During the slice feeding, the push plate 106 moves forward and then backwards under the next to be dispensed hanger, with the push plate sliding under the next to be released hanger, which is constrained from movement by magazine 102. The sliding surface of push plate 106 prevents the hanger above the push plate 106 from dropping to the main base 94 until the push plate 106 is fully retracted. At that time, the next to be dispensed hanger is exposed to the main base 94, which allows the stack of hangers to drop downwardly so that the next hanger to be dispensed rests on the main base 94. This hanger is then advanced with the next reciprocation. The thickness of the hanger and the dimensions of the dispensing slot and the thickness of the push plate 106 prevent multiple hangers in the magazine from being dispensed or causing the device to jam on a second hanger.

The present invention is intended to work with either wire hook hangers or plastic hook hangers, and the forgoing description is equally applicable to both types of hangers. Optionally, when plastic hook hangers are used, it may be desirable to automatically affix a size cap to the hanger at the time the hanger is positioned for garment loading. The following description is relevant to this option.

When desired, the present invention enables the size caps to be automatically attached to the hook portion 111 of the hanger 100. As illustrated in FIGS. 8 and 9, a size cap magazine 110 may be located between the hanger magazines 102*a*, 102*b* and the push plate reciprocating cylinder 112. The mechanism works in concert with the reciprocating action of the push plate 106. Again using a slice feeding technique, a portion of the push plate 106 is designed to remove a single size cap 101 from the size cap magazine 110 each time the device moves towards the operator, and the size cap is then affixed to the hanger as the hanger advances towards the operator. As described previously with respect to the hangers, subsequent size caps in the magazine are prevented from release from the size cap magazine 110 by the dimensions of the opening below the magazine, the thickness of the size cap and the thickness of the push plate 106 immediately following the receptacle or cut out for the size cap. The leading edges of the push plate arms 109*a*, 109*b* may be supplied with compressible resilient engaging means at the point of engagement with the hanger support bar 105. This resilient mounting allows the size cap to be forced onto the flange 120 of hanger hook 111 of the hanger 100, without placing extraordinary stress on the hanger hook 111, the flange 120 of hanger hook 111, or the hanger 100.

The following is an example of the operation of the present invention utilizing size caps 101 that are mounted on a hanger hook 111. Typically the hanger hook flange 120 and the size cap 101 have engagement formations which require a certain amount of force to overcome the resistance, but upon application of such force in the engagement of the two pieces, the hanger 100 and size cap 101 snap fit to one another. The snap fit may be permanent, as taught by U.S. Pat. No. 5,604,975, or releasable, as taught by U.S. Pat. No. 5,794,363. As noted above, both of these patents are assigned to the assignee of the present invention, and the disclosures of both patents are incorporated herein by reference thereto. As the push plate 106 begins its first reciprocal movement towards the operator, a size cap 101 is removed from the size cap magazine 110. The removed size cap is captured within a cut out or a receptacle 178 (illustrated in FIG. 8) mounted on the push plate 106 and fed to the flange portion 120 of the hook 111 to which it will be attached. Before the engagement arms 109*a*, 109*b* engage the hanger support bar 105, the size cap is advanced over the hanger flange 120, and by the time the engagement arms 109*a*. 109*b* engage the hanger, the flange 120 is positioned within an internal recess in the size cap 101. The hanger and size cap assembly, with the cap loosely applied to the flange 120 of the hanger 100, are moved towards a hanger stop position at hanger stop 103. Upon reaching the hanger stop 103, the hanger 100 and hanger bar 105 are stopped. However, the push plate 106 continues to move towards the operator a short distance. This distance enables compression of the resilient engagement tips at 109*a*, 109*b* which allows the push plate 106 to force the snap fit engagement of size cap 101 to flange 120 of hanger hook 111. Due to the compressive force imparted on the size cap by the push plate 106 as it moves through the resilient mounting at 109*a*, 109*b*, the size cap is firmly seated on hanger flange 120 in a snap fit engagement with the hanger. The resilient mounting of the push plate 106 insures that the force imparted upon the hanger 100 is not so great to damage the hanger hook 111 or the hanger support bar 105. Alternately the same effect may be accomplished by resiliently mounting a size cap receptacle to push plate 106. The resilient engagement allows a small amount of over travel which forces the size cap onto the hook without damaging the hook.

The push plate 106 is advanced and retracted by a reciprocating cylinder 112. In the example shown in FIGS. 1–5, the reciprocating cylinder 112 is a double acting pneumatic cylinder, however, it is understood that the reciprocating cylinder could be of a variety of other designs. The reciprocal movement of the push plate 106 defines a centerline axis for the mechanism.

As the push plate 106 is advanced towards the operator, and after the push plate has engaged the size cap and hanger 100, and positioned the hanger at the hanger load position, a control engagement cam 125 engages an pneumatic switch 124, which initiates a pneumatic signal which is sent through the pneumatic control system to actuate a pair of pinch grip cylinder rams 114*a*, 114*b*. The stroke of cylinder 112 limits the travel of the push plate 106 so that there is no further movement of the push plate after reaching a stop position and hanger stop 103. When the hanger reaches the stop position, each of the pinch grip cylinders 114*a*, 114*b* project rams 122 onto their respective pinch grips of the hanger 100, as illustrated in FIG. 9 opening the pinch grips 90*a*, 90*b* and overcoming the opposition of the pinch grips spring which keeps the pinch grip in a normally closed position.

With the pinch grips 90*a*, 90*b* open and the hanger secured in the stop position, the operator can insert a garment into the now open pinch grips. As illustrated in FIG. 9 proximately located to the open pinch grips, and preferably external to the rams 122 and pinch grips 90*a*, 90*b* are triggering devices 116. The triggering devices 116*a*, 116*b* are actuated by the outer edges of the garment when the operator places the garment in the pinch grip clips 90*a*, 90*b*. The operator picks up a garment to be hung from the hanger 110, typically a pair of slacks or a skirt, and pulls the waistband taut between her hands. The taut waistband is then inserted into the pinch grips 101 with both hands on the outside of the device, whereby the triggers 116 are actuated by the portions of the garment that extends beyond the outer edges of the hanger. The device also employs a sloping garment guide 94*a* which joins main base 94 to assist the operator and guide the garment waist band into pinch grips 90*a*, 90*b*.

The placement of the triggers 116 to each side of the location where the garments are inserted provides an added safety feature for the device. Since there is no opportunity for an operator to inadvertently injure herself while operating the device. This is a result of the dual trigger mechanism, which necessitates that the operator grip the garment at its outer edges, and pull it taut for insertion. The operator must pull the garment outward at its ends with both hands to insure that there is no sagging of the garment between the grips. Thus, both of the triggers are tripped while the garment is in the proximate location after it is inserted into the pinch grips. As a result of requiring the operator to use both hands to hold the garment to trip the triggers, there is a reduced likelihood that the operator can inadvertently injure himself or herself. This increased safety is due largely to the fact that their hands are holding the ends of the garment, and therefore cannot inadvertently engage any of the reciprocating elements of the device.

Upon triggering, two actions take place. Instantly, the pinch grip cylinder rams 122(*a*) and 122(*b*) are retracted. The retraction allows the spring force of each pinch grip 90 to return to its normally closed position, thereby securely gripping the garment there between. This permits the operator to lift the hanger and garment combination off of the main base 94, and place the combination elsewhere for further processing. Secondly, the push plate 106 begins moving in a direction away from operator. As the push plate 106 passes the magazine 102, a new hanger 100 drops to the main base 94 and the process begins a new.

FIG. 7 is an enlargement of a portion of FIG. 9 which illustrates a stack of the improved pinch grip hangers of the present invention loaded in magazine 102 with the reciprocating push plate 106 positioned immediately therebelow. Each of the hangers is dimensioned such that the outer portion of the arch 40 on each of the moveable jaws 12 is essentially parallel to the tip 41 of the user engagement portion 24. This enables the tip 41 of the user engagement portion 24 to rest against the flat surface defined by rear wall 30A illustrated in FIGS. 6A–6C. The forward of portion of arch 34 engages the rear arch 32 formed on the fixed jaw 10 as previously described. As noted previously, the rear wall of the fixed jaw is offset from the rear wall of the hanger body 105 and accordingly hook member 111. Inasmuch as each hanger has a pair of pinch grip, and there are two points of engagement on each pinch grip, the present invention this provides a stable 4 point mounting of the pinch grip hangers when they are stacked on one another and loaded into a magazine such as magazine 102 illustrated in FIG. 7. This facilitates the automatic dispensing of the hangers from magazine 102 by push plate 106. As described above, and if desired, size caps may be loaded in magazine 110, and a size cap will be affixed to the hanger as it is dispensed by the push plate 106.

Referring again to FIG. 2, the garment hanger of the present invention is generally referred to by reference numeral 100. The hanger body or horizontal support bar 105 has at least one flange or web 120*a* for removably securing a side size indicator (FIG. 12*a*–12*c*) to the web 120*a* molded onto support bar 105. As illustrated in FIG. 2, the web 120*a* is located at a junction between the hook 111*a* and the body 105. The flange or web 120*a* may be also be molded adjacent an all plastic hook and hanger, such as the hanger illustrated in FIG. 1.

Figure 13A:
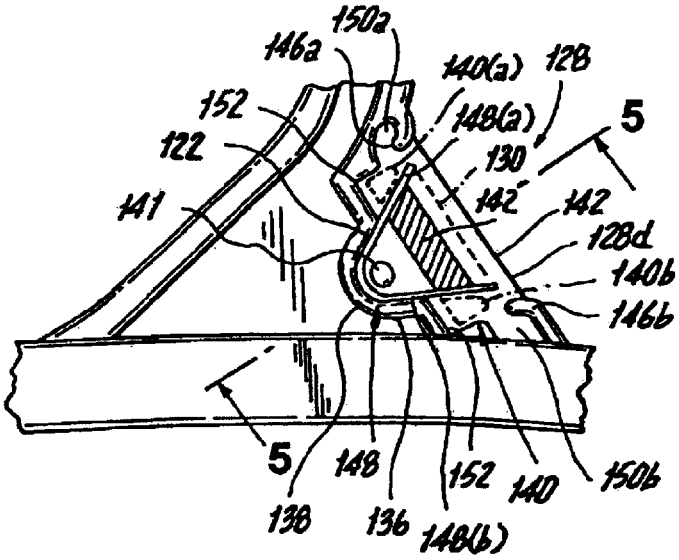
FIG. 13(*a*) illustrates an enlarged view of the first web of FIG. 2.
Figure 14A:
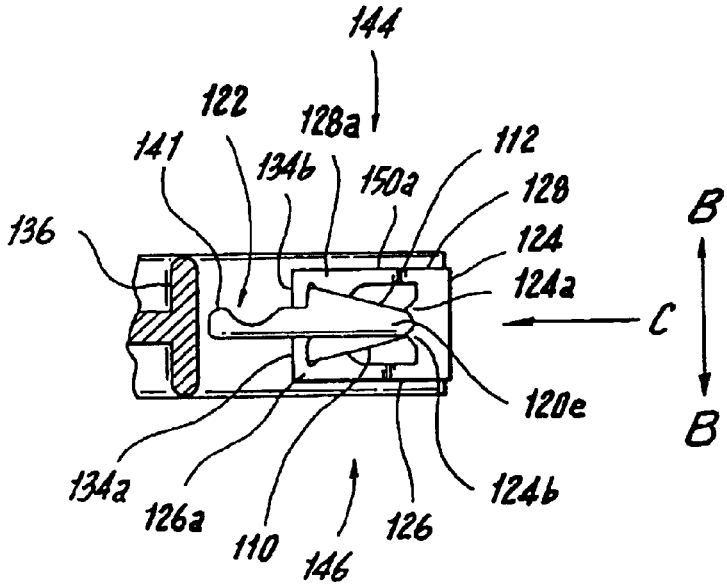
FIG. 14(*a*) illustrates a partial sectional view of the web of FIG. 13 as taken along line 5—5 thereof and additionally having the second version of the size indicator secured thereon.
Figure 14B:
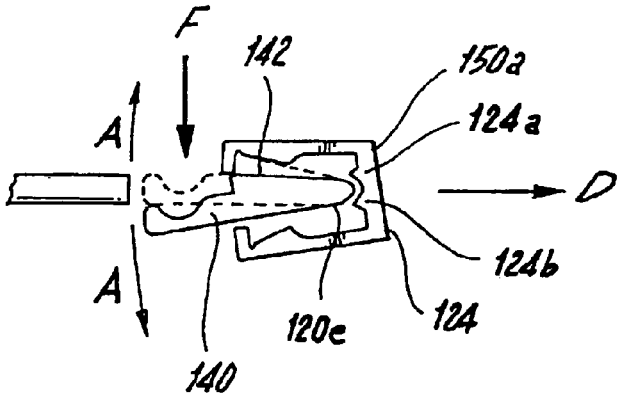

Referring Now to FIG. 13*a*, the web has a fixed latch 140 and a pivoting latch 142. The pivoting latch 142 is preferably located at a central portion of the web 120*a* and the fixed latch 140 is located on at least one end of the pivoting latch 142. Preferably, the fixed latch 140, as shown in FIG. 3, comprises two abutments 140*a*, 140*b* located on each end of the pivoting latch 142. As illustrated in FIGS. 14*a* and 14*b*, it is also preferable that the pivoting latch 142 projects from a first side 144 of the web 120*a* and the fixed latch 140 projects from an opposite side 146 of the web 120*a*.

Referring back to FIG. 13*a*, the pivoting latch 142 is preferably defined by a slot 148 cut through the web 120*a*. The slot preferably has a shape defined by at least two sides 148*a*, 148*b*. The pivoting latch 142 is further defined by a living hinge, shown by dotted line 120*c* closing the shape of the slot 148. As shown in FIG. 13*a*, the slot 148 is preferably substantially two sided 148*a*, 148*b* and the living hinge 120*c* closes the shape of the slot 148 thereby forming a triangular shaped pivoting latch 142.

Figure 13B:
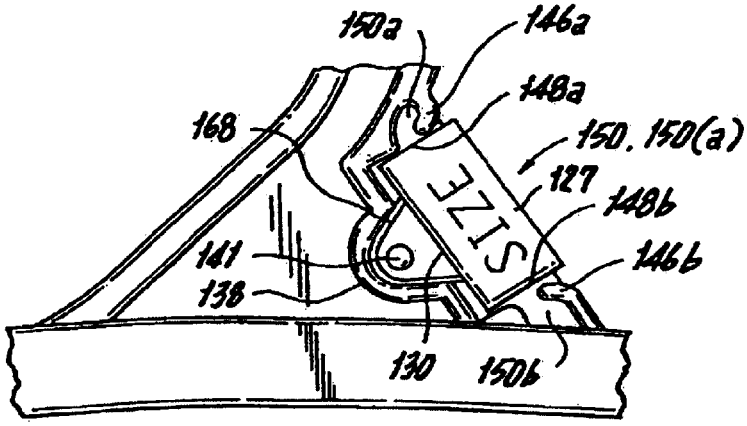

Referring now to FIGS. 13*a*, 13*b*, and 14*a* in combination, the pivoting latch 142 preferably has an engagement means for facilitating movement of the pivoting latch about arrow A shown in FIG. 14*b*. The engagement means preferably comprises a cantilevered end 122 of the pivoting latch 142 which when a releasing force (F) is applied thereto provides a mechanical advantage for movement of the pivoting latch 142 out of engagement with the size indicator. Simultaneously, the opposite side of the pivoting latch 142 displaces the size indicator such that it no longer engages the fixed latch 140.

Figure 12A:
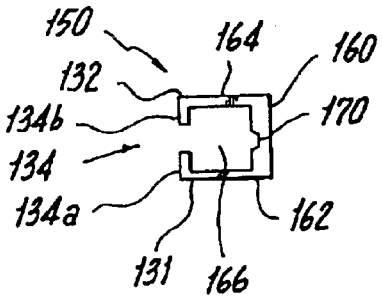
FIGS. 12(*a*) and 12(*c*) illustrate an end view of a first and second version, respectively, of a first embodiment of a size indicator of the present invention for engaging the first web of the hanger illustrated in FIG. 2.
Figure 12B:
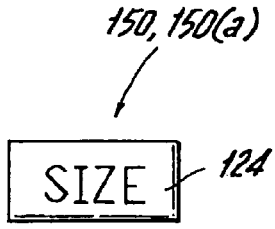

Referring now to FIGS. 12*a*, 12*b*, and 14*a* in combination, two versions of the size indicator are illustrated as 150 and 150*a*, with size indicator 150 generally having a face 124 and two sides 126, 128 depending therefrom to form a generally C-shaped channel 129. Each of the sides 126, 128 terminate in a foremost edge 130, 132. The foremost edges 130, 132 are preferably configured such that the cantilevered end 122 of the pivoting latch 112 is exposed when a size indicator 150 is secured on the web 120*a*.

The size indicator 150 includes finger means 134 for engaging the fixed and pivoting latches 140, 142, respectively, such that the size indicator is secured on the web during normal use. However, the size indicator is releasably secured on the web 120 such that it may be released from the web 120*a* when the pivoting latch 142 is pivoted out of engagement with the finger means 134 of the size indicator when the release force (F) is applied. The finger means 134 preferably comprises an inwardly facing ridge 134*a*, 134*b* disposed at each of the foremost edges 130, 132 and projecting inwards towards the channel 129 of the size indicator 150.

Figure 12C:
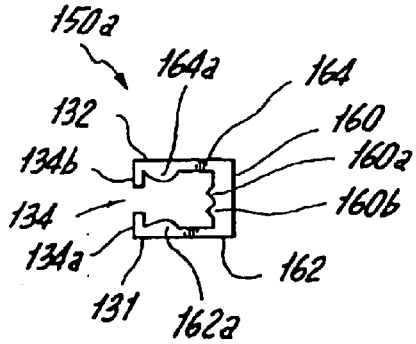

In an alternative version, a second size indicator 150*a* of the first embodiment is illustrated in FIG. 12*c* in which like reference numerals refer to similar features, the second size indicator being referred to generally by reference numeral 150*a*. The second size indicator 150*a* has engagement abutments 126*a* and 128*a* which protrude from the inside of the sides 126, 128, respectively, to touch the side walls of the fixed and pivoting latches 140, 142 when secured to the web 106*a*. As will be discussed below, the size indicator 150*a* further has a pair of spaced projections 124*a*, 124*b* projecting from an inner surface of the face 124.

Referring back to FIGS. 13*a* and 14*a* in combination, the web preferably also has a guard 136 extending across the web 120*a* and below the size indicator 150*a*. In a preferred implementation, the guard 136 has a down-turned portion 138 which follows the contours of the cantilevered end 122 to thereby enable access to the edges of the size indicator and the engagement means 122 but prevents inadvertent actuation of the pivoting latch 142. The cantilevered end and engagement means 142 are preferably configured to engage a tool (not shown) used for application of the releasing force (F). The engagement means is preferably a dimple 141 formed on a side of the cantilevered end 122. The tool having a tip substantially conforming to the shape of the dimple 141 and having a width such that it is not prevented from engaging the dimple 141 by the guard The web preferably also has an outermost edge 120*d* having an outermost portion 120*e* of a predetermined cross-section. The first version of the size indicator 150 has a trough 124*c* (FIG. 12*a*) with a mating cross-section substantially configured to receive the outermost portion 120*d* therein for preventing a lateral movement of the size indicator along direction B—B (FIG. 14*a*)when the size indicator 150 is secured on the web 120*a*. The preferable predetermined cross-section of both the outermost portion 120*e* and the trough 144 is substantially rectangular. The second version of the size indicator 150*a* having first and second spaced projections 124*a* and 124*b*, respectively, which project from the inner surface of the face 124. The first and second projections 124*a*, 124*b* are spaced such that the outermost portion 120*e* is accepted therein when the size indicator 150*a* is secured on the web 106*a* to prevent lateral movement of the size indicator 150*a* along direction B—B (illustrated in FIG. 14*a*).

The engagement abutments 126*a*, 128*a* cooperate with the trough 144 or the first and second spaced projections 124*a*, 124*b* to prevent side to side movement of the size indicator on the web and contribute to a secure and solid attachment of the size indicator tot he hanger.

Referring to FIG. 13*b*, the web 120*a* further comprises locating means for locating the size indicators 150, 150*a* in a predetermined position on the web 120*a*. The locating means preferably comprises first and second guides 146*a*, 146*b* disposed adjacent each side edge 148*a*, 148*b* of the size indicator 150, 150*a* and spaced apart to align the size indicators therebetween and to center the size indicators during application thereof on the web 120*a*. Preferably, the first and second guides 146*a*, 146*b* do not extend the full length of the side edges 148*a*, 148*b* of the size indicator but define elongate openings 150*a*, 150*b* which expose the side edges 148*a*, 148*b* of the size indicator.

Referring now to FIGS. 14*a* and 14*a*, the operation of the garment hanger 100*a* of the present invention will be explained with regard to size indicator 150*a*. Size indicator 150*a* is mounted on the web 120*a* by sliding it over web 120*a* in the direction of arrow C. While being mounted in the direction of arrow C, the pivoting latch 142 pivots in the direction of arrow A until the inwardly facing ridges 134*a*, 134*b* of finger means 134 pass over the fixed and pivoting ridges 140, 142. After which, the inwardly facing fingers 134*a*, 134*b* snap into place in an area defined by the guide 136 and a bottom edge of the fixed and pivoting ridges 140, 142. As such, the size indicator 150*a* is releasably secured on the web 120*a*.

To release the size indicators 150, 150*a* from the web 120*a*, a releasing force (F) is applied to the cantilevered end 122 of the pivoting latch 142, preferably by engaging the dimple 141 thereon with a release tool (not shown). The release force (F) results in the pivoting latch 142 to pivot about the living hinge 120*c* in the direction of arrow A. As can be seen in FIGS. 14*a* and 14*b*, planar side wall of the pivoting latch 142 causes the inner ridge 134*a* of the finger means 134 of size indicators 150, 150*a* to extend past the furthest extending portion of the fixed latch 140. At this point, the size indicator 150, 150*a* may be manually removed from the web 120*a*.

While several embodiments and variations of the present invention for a pinch grip hanger mechanism are described in detail herein, it should be apparent that the disclosure and teachings of the present invention will suggest many alternative designs to those skilled in the art.

We claim:

1. An elongated pinch grip garment hanger comprising:

a) a center support member and a hook member, the hook member connected to said support and upwardly extending from said support;

b) a first pinch grip member comprising:

i. a fixed jaw member, integrally molded to said center support;

ii. a movable jaw member pivotally secured to said fixed jaw member;

iii. a multi-stage spring member having a forward and rearward end fixedly connected to the movable and fixed jaw members, respectively, at least one forward linear element and at least one rearward linear element, and an arch fulcrum, said fulcrum having a forward fulcrum end and a rearward fulcrum end, said arch being defined between said fulcrum ends, said forward fulcrum end integrally molded to an upper end of said forward linear element; and said rearward fulcrum end being integrally molded to an upper end of said rearward linear elements;

iv. said fixed and movable jaw members having:

1. means for providing pivotal motion to said movable jaw;

2. means for preventing lateral shifting of said movable jaw;

3. a user engaging portion for opening the pinch grip;

4. a garment engaging section;

5. means for preventing inadvertent actuation of the pinch grip; and 6. an extension portion connecting said garment engaging area to said means for preventing inadvertent actuation of the pinch grip, so that a waistband section of a garment may be placed within a cavity defined by the space above said garment engaging area.

2. The pinch grip member of claim 1, wherein:

a) said means for providing pivotal motion to said movable jaw comprises:

i. At least one pivot post molded to said fixed jaw, at least one pivot socket molded to said movable jaw, where the pivot socket and the pivot post define the pivot axis for the pinch grip; and b) said means for providing preventing lateral shifting of said movable jaw comprises:

i. At least one flange, molded to the movable jaw and bound outside of the socket to prevent lateral shifting of the movable jaw;

ii. An opening in said movable jaw and a fixed post molded to said fixed jaw, said fixed post extending forwardly through said opening upon lateral movement of said movable jaw to laterally constrain the moveable jaw; and iii. An opening in said fixed jaw and at least one rearwardly projecting flange, mounted to said movable jaw, for maintaining consistent alignment throughout said pinch grip range of motion.

3. The pinch grip hanger of claim 1, wherein:

a) the spring further comprises:

i. a first safety lock on the bottom of the forward end for locking said forward end to said movable jaw;

ii. and a second safety lock molded to the bottom of the rearward end for locking said rearward end of said spring to said fixed jaw; and iii. said spring member being snug fitted to said fixed and movable jaws or fitted to engage the fixed and movable jaws on each safety lock; and b) said fixed and movable jaws comprise:

i. A bight section for locking said safety lock to the rearward and forward ends of said spring to the fixed and movable jaw, respectively.

4. The pinch grip hanger of claim 1, where said means for preventing inadvertent actuation further comprises:

a) An arch, said arch connecting said garment engaging area to said pivot means, wherein:

i. said arch bows outwardly, below said pivotal means, so that when said garment engaging area engages a garment, the arch on said movable grip extends beyond said user engaging portion, so that an impact between two adjacent garment hangers tends to close the pinch grip;

b) A guard member, mounted on the forward face of said fixed jaw; wherein:

i. said guard member extends forwardly past a centerline of said hanger support member, so that:

1. When the pinch grip has engaged a garment between the fixed and movable jaws, said guard member extends beyond said user engaging section to prevent the accidental dislodgement of garments from the pinch grip when two adjacent hangers are inadvertently pressed together; and 2. When the pinch grip is closed and not in use, the user engagement portion extends beyond the guard.

5. The pinch grip hanger of claim 1, wherein:

a) Said center support member has a square-M cross section, said support member having:

i. an offset from the center axis of the center support so that the overall thickness of the hanger is reduced; wherein the amount of offset and the amount of opening of the jaw is determined by the length of the pivot post; and b) Said fixed and movable jaws further comprise:

i. at least one channel molded along said arch and said extension area; and ii. an outer shroud portion, molded to the forward face of said fixed jaw, opposing said guard member.

6. The pinch grip hanger of claim 1, wherein said user engaging section extends upwardly from the pivot post to enable the user to open the pinch grip for insertion of a garment within the garment engaging area.

7. An improved pinch grip hanger, said hanger comprising;

a) a hook and a support bar suspended from said hook, b) at least one pinch grip mounted on said support bar at a first end thereof, said pinch grip having first and second pinch jaws, with the first jaw mounted on said support bar in a fixed location, and the second jaw pivotally mounted on said first jaw and spring biased into engagement with said first jaw, said second jaw having a user engagement portion extending upwardly prom a pivot axis defined at said pivotal mounting, and garment engaging portion extending downwardly from said pivot axis, said user engagement portion enabling a user to open the pinch grip for insertion or release of a garment in said pinch grip, said spring bias enabling said pinch grip to clamp and suspend a garment between said first and second pinch grip jaws in normal use, c) a guard portion formed on said second pinch grip jaw below the pivot axis of said jaw, such that when two or more improved pinch grip hangers are suspended from their respective hooks with garments clamped in their respective pinch grips, the guard portion on the second jaw of the first of two hangers will engage the first pinch grip jaw of the second of said two hangers below the pivot axis of each of the pinch grips when the hangers are pressed together, thereby preventing accidental actuation of the pinch grips and release of die garments, d) an elongated portion connecting said garment engaging portion to said guard portion, so that a waistband section of a garment maybe placed within a cavity defined by the space above said garment engaging portion.

8. An improved pinch grip hanger as claimed in claim 7, wherein said hanger is formed of plastic with said first pinch grip jaw integrally molded with said support bar, and said second pinch grip jaw secured thereto by a resilient spring along said pivot axis.

9. An improved pinch grip hanger as claimed in claim 8, wherein said guard portion is formed by a contoured arch that extends outwardly from said second pinch grip jaw beyond the user engagement portion when a garment is engaged in said pinch grip, thereby preventing accidental actuation of said pinch grip.

10. An improved pinch grip hanger as claimed in claim 9, wherein said second pinch grip is formed with an undulating contour having outwardly and inwardly extending portions, whereby a first outwardly extending portion defines said user engagement portion, and a second outward portion defines said guard portion, with said second portion extending outwardly beyond said first portion when a garment is engaged therein.

11. An improved pinch grip hanger, said hanger comprising;

a) a hook and a molded plastic support bar suspended from said hook, said support bar defining a horizontal axis, with a vertical plane defined by said horizontal axis and a vertical axis extending upward in the direction of the hook, and extending downwardly below said support bar;

b) first and second pinch grips mounted on said support bar at first and second ends thereof, said pinch grips defining a first depth in a direction perpendicular to said vertical plane, each of said pinch grips having first and second pinch grip jaws, with the first pinch grip jaws integrally molded on the ends of said support bar, with the second pinch grip jaws pivotally mounted on said first pinch grip jaws and spring biased into engagement with said first pinch grip jaws, each of said second pinch grip jaws having a user engagement portion extending upwardly prom pivot axis defined at said pivotal mountings, with garment engaging portions extending downwardly from said pivot axis, said user engagement portions enabling a user to open the pinch grip jaws for insertion or release of a garment in said pinch grips, said spring bias enabling said pinch grips to clamp and suspend a garment between each of said first and second pinch grip jaws in normal use, c) a moving guard portion formed on each of said second pinch grip jaws below the pivot axis of said jaws;

d) an extension portion connecting said garment engaging portion to said guard portion, so that a waistband section of a garment maybe placed within a cavity defined by the space above said garment engaging portion, e) an offset mounting portion securing each of said pinch grips to said horizontal body member, said first jaws defining a back plane for said hanger offset from said vertical plane with at least one pivot post formed on each of said first jaws, said pivot posts extending outwardly from the said first jaws to define said pivot axis beyond the vertical plane of said hanger, with each of said second pinch grip jaws secured to said pivot posts by first and second resilient springs to define said pivot axis, said first pinch grip jaws being offset from the vertical plane of the hanger by approximately one half the distance of the first depth to thereby reduce the depth of the hanger in normal use;

f) a fixed guard portion formed at said offset mounting, said fixed guard portion having a depth defined by the depth of the pinch grip when a garment is clamped in said pinch grip and suspended from said pinch grip, said fixed guard extending perpendicularly from said backplane a distance at least equal to said first depth to protect the user engagement portions of said second pinch grip jaws when a garment is engaged in said pinch grip jaws, such that when two or more improved pinch grip hangers are suspended from their respective hooks with garments clamped in their respective pinch grip jaws, the moving guard portions on the second pinch grip jaws of the first of two hangers will engage the first pinch grip jaws of the second of said two hangers below the pivot axis of each of the pinch grips when the hangers are pressed together, and the fixed guards will engage the back plane of the first pinch grip jaws of the second of said two hangers, said fixed guards and said moving guards thereby preventing accidental actuation of the pinch grips and release of the garments.

12. An improved pinch grip hanger as claimed in claim 11, in which each of said offset portions define an opening along a trajectory defined by an end of the user engagement portion, said opening allowing said end of said user engagement portion to pivot over the pivot axis and through the back plane of the hanger, to provide greater jaw opening dimensions for said pinch grip jaws.

13. An improved pinch grip hanger as claimed in claim 11, which further includes first and second multi-stage springs for joining each of first and second pinch grip jaws, said multi-stage spring having plural stages of spring engagement to maintain a relatively constant spring bias throughout the range of motion of each of said pinch grips.

14. An improved pinch grip hanger as claimed in claim 11, wherein said moving guard portion is formed by a contoured arch that extends outwardly and perpendicularly from said second pinch grip jaws beyond the user engagement portions when a garment is engaged in said pinch grips, thereby preventing accidental actuation of said pinch grips.

15. An improved pinch grip hanger as claimed in claim 14, wherein each of said second pinch grip jaws are formed with an undulating contour, with outwardly and inwardly extending portions, whereby a first outwardly extending portion defines said user engagement portions, and a second outward portion defines said moving guard portions, with said second portions extending outwardly beyond said first portions when a garment is clamped in said pinch grips.

16. An improved pinch grip hanger as claimed in claim 15, wherein a first inwardly extending portion of said undulating contours defines a pivot mount for said pivot posts, and a second inwardly extending portions define a garment engaging areas.

17. An improved pinch grip hanger as claimed in claim 16, wherein the fixed guard and the moving guard portion of each pinch grip engages the second of said two hangers to provide a multi point engagement when the hangers are pressed together, said fixed guards and said moving guards together preventing accidental actuation of the pinch grips and release of the garments.

18. An improved pinch grip hanger as claimed in claim 16, wherein said moving guards and a tip of said user engagement portions are of equal depth with respect to a backplane of said support bar prior to engaging a garment, to provide a 4 point stacking engagement between adjacent hangers when empty hangers are loaded in a hanger magazine.

19. The pinch grip hanger of claim 1 or 7 or 11, where said garment engaging area comprises at least a first tooth, molded to said fixed jaw and forwardly extending from said fixed jaw towards said movable jaw, and at least a second tooth molded to the movable jaw and rearwardly extending from said movable jaw toward said fixed jaw.

20. The pinch grip hanger of claim 19, wherein a bottommost tooth on said movable jaw is upward of a bottommost tooth on said fixed jaw when said jaws are closed and not in use, and each tooth projects past the tip of the opposing tooth.

21. The pinch grip hanger of claim 19, wherein a bottommost tooth on said movable jaw is downward of a bottommost tooth on said fixed jaw when said jaws are closed and not in use, and each tooth projects past the tip of the opposing tooth.

22. The pinch grip hanger of claim 19, where said at least one tooth on said movable jaw meets the tip of said at least one tooth on the fixed jaw when said jaws are closed and not in use.

23. The pinch grip hanger of claim 1 or 7 or 11, where said extension portion is essentially linear.

24. The pinch grip hanger of claim 23 where said extension area is essentially 1 inch in length.

* * * * *